US010932527B2

(12) United States Patent
Hatfield et al.

(10) Patent No.: US 10,932,527 B2
(45) Date of Patent: Mar. 2, 2021

(54) CLEATED FOOTWEAR WITH FLEXIBLE CLEATS

(71) Applicant: NIKE, Inc., Beaverton, OR (US)

(72) Inventors: Tobie D. Hatfield, Lake Oswego, OR (US); Thomas G. Bell, Portland, OR (US); Carl L. Madore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 561 days.

(21) Appl. No.: 15/616,003

(22) Filed: Jun. 7, 2017

(65) Prior Publication Data

US 2017/0265595 A1 Sep. 21, 2017

Related U.S. Application Data

(63) Continuation of application No. 13/971,395, filed on Aug. 20, 2013, now Pat. No. 9,700,103.

(51) Int. Cl.

| | |
|---|---|
| ***A43C 15/02*** | (2006.01) |
| ***A43B 13/14*** | (2006.01) |
| ***A43C 15/16*** | (2006.01) |
| ***A43B 5/00*** | (2006.01) |

(52) U.S. Cl.

CPC ..... *A43C 15/02* (2013.01); *A43B 5/00* (2013.01); *A43B 13/141* (2013.01); *A43C 15/162* (2013.01)

(58) Field of Classification Search

CPC ..... A43C 15/02; A43C 15/162; A43C 15/16; A43B 5/00; A43B 13/141; A43B 5/001

USPC ..... D2/947; 36/134, 126, 128, 59 R, 59 C, 36/67 A

See application file for complete search history.

(56) References Cited

U.S. PATENT DOCUMENTS

| | | | | |
|---|---|---|---|---|
| 3,010,229 A | | 11/1961 | Snitzer | |
| 4,393,604 A | * | 7/1983 | Crowley | A43C 15/162 36/126 |
| 5,012,597 A | | 5/1991 | Thomasson | |
| 5,461,801 A | | 10/1995 | Anderton | |

(Continued)

FOREIGN PATENT DOCUMENTS

| | | |
|---|---|---|
| CN | 102406276 A | 4/2012 |
| EP | 2430937 A1 | 3/2012 |

(Continued)

OTHER PUBLICATIONS

International Search Report dated Nov. 4, 2014 in PCT Application No. PCT/US2014/051510.

(Continued)

*Primary Examiner* — Nathan E Durham
*Assistant Examiner* — Abby M Spatz
(74) *Attorney, Agent, or Firm* — Banner & Witcoff, Ltd.

(57) ABSTRACT

Flexible cleats for flexible footwear (e.g., with natural motion sole structures) include a cleat structure that generally has the appearance of a cleat that has been separated into individual component parts by one or more flex grooves formed into the sole structure. Such structures provide additional flexibility at the areas of the cleats so as to avoid a "stiff" feeling in certain areas and/or during certain activities. The flexible cleats may be arranged around one or more intersections of flex grooves provided in a sole member, optionally in the form of an array of sole pods provided at least in a forefoot area of the sole member.

16 Claims, 14 Drawing Sheets

(56) References Cited

U.S. PATENT DOCUMENTS

| | | | | |
|---|---|---|---|---|
| D392,446 | S | 3/1998 | Fogg | |
| D394,141 | S | 5/1998 | Takaoka et al. | |
| 5,806,209 | A | 9/1998 | Crowley et al. | |
| 6,016,613 | A | 1/2000 | Campbell et al. | |
| 6,161,315 | A | 12/2000 | Dalton | |
| D468,079 | S * | 1/2003 | DeGrand | D2/947 |
| 6,826,852 | B2 | 12/2004 | Fusco | |
| D539,516 | S | 4/2007 | McClaskie | |
| D559,511 | S | 1/2008 | Wu | |
| 7,347,011 | B2 | 3/2008 | Dua et al. | |
| 7,707,748 | B2 | 5/2010 | Campbell | |
| 8,146,272 | B2 | 4/2012 | Dukovic et al. | |
| D659,361 | S | 5/2012 | Jolicoeur | |
| 8,321,984 | B2 | 12/2012 | Dojan et al. | |
| 8,333,024 | B2 | 12/2012 | Fallow et al. | |
| 8,429,835 | B2 | 4/2013 | Dojan et al. | |
| 2002/0078598 | A1 * | 6/2002 | Bell | A43B 13/223 36/59 R |
| 2003/0093926 | A1 * | 5/2003 | Auger | A43C 15/161 36/134 |
| 2006/0130361 | A1 | 6/2006 | Robinson et al. | |
| 2007/0199213 | A1 | 8/2007 | Campbell et al. | |
| 2010/0115796 | A1 | 5/2010 | Pulli | |
| 2011/0247237 | A1 | 10/2011 | Jara et al. | |
| 2012/0066933 | A1 | 3/2012 | Meythaler | |
| 2013/0067772 | A1 | 3/2013 | Auger et al. | |
| 2013/0104422 | A1 | 5/2013 | Hatfield et al. | |
| 2013/0104423 | A1 | 5/2013 | Hatfield et al. | |
| 2013/0333247 | A1 | 12/2013 | Grott et al. | |

FOREIGN PATENT DOCUMENTS

| | | | |
|---|---|---|---|
| JP | 2011-244903 | A | 12/2011 |
| JP | 2012504480 | A | 2/2012 |
| JP | 2012139348 | A | 7/2012 |
| WO | 2007138947 | A1 | 12/2007 |
| WO | 2013019934 | A1 | 2/2013 |
| WO | 2014022647 | A1 | 2/2014 |

OTHER PUBLICATIONS

Non Final Office Action dated Sep. 24, 2015 in U.S. Appl. No. 13/971,395.

Apr. 25, 2016—U.S. Final Office Action—U.S. Appl. No. 13/971,395.

Jan. 16, 2017—(CA) Office Action—App 2,918,839.

Jan. 16, 2017—(EP) Office Action—App 14756217.7.

Apr. 3, 2017—(JP) Office Action—App 2016-536354.

Sep. 25, 2018—(EP) ESR—App. No. 18176487.9.

* cited by examiner

CLEATED FOOTWEAR WITH FLEXIBLE CLEATS

RELATED APPLICATION DATA

This application is a continuation of co-pending U.S. patent application Ser. No. 13/971,395 filed Aug. 20, 2013 and entitled "Cleated Footwear with Flexible Cleats, in the names of Tobie D. Hatfield, Thomas G. Bell, and Carl L. Madore. U.S. patent application Ser. No. 13/971,395 is entirely incorporated herein by reference.

FIELD OF THE INVENTION

The present invention relates to the field of footwear. More specifically, aspects of the present invention pertain to cleat structures, footwear sole structures including such cleat structures, and articles of footwear (e.g., athletic footwear) that include such cleat and sole structures. Additional aspects of this invention relate to methods of making footwear sole structures and/or articles of footwear including these cleat structures.

BACKGROUND

Cleated footwear provides enhanced traction for athletes in various activities, such as baseball, softball, football, soccer, golf, etc. The cleats provided on such footwear may have different sizes, shapes, orientations, and arrangements on the footwear sole structure, e.g., for use in different activities and/or under different field conditions.

Cleated footwear, particularly for golf, traditionally has included a relatively stiff board or base running the entire length and width of the sole structure, e.g., to support mounting of cleats and removable cleat receptacles and to stably support the golfer during all phases of swinging actions. Such footwear, however, can be quite uncomfortable, particularly when walking several miles during a round of golf. In recent years, however, there has been increased interest and desire toward more natural motion and/or more "minimalist" constructions for footwear, including cleated footwear (even for golf footwear). Accordingly, further options and advances in natural motion cleated footwear structures would be a welcome advance in the art.

SUMMARY

This Summary is provided to introduce some general concepts relating to this invention in a simplified form that are further described below in the Detailed Description. This Summary is not intended to identify key features or essential features of the invention.

Some aspects of this invention relate to flexible cleats and sole structures for articles of cleated footwear that have improved flexibility and/or improved natural motion capabilities. Flexible cleats for footwear (e.g., with improved natural motion sole structures) may include a cleat structure that generally has the appearance of a cleat that has been separated into two or more individual component parts by one or more flex grooves that extend into the sole structure (e.g., a cleat cut into parts by one or more flex grooves). Such cleat structures provide additional flexibility at areas of the cleats so as to avoid a "stiff" feeling in certain areas and/or during certain activities and to provide or support more natural motion.

Sole structures according to at least some examples of this invention include a sole member having an exterior surface and an opposite interior surface for supporting the wearer's foot. This sole member includes: a first flex groove that extends at least partially through the sole member from the exterior surface in a direction toward the interior surface, and a second flex groove that extends at least partially through the sole member from the exterior surface in a direction toward the interior surface, wherein the first and second flex grooves meet to form a junction. At least one flexible cleat extends in a direction away from the interior and exterior surfaces of the sole member and includes at least: (a) a first cleat component that includes a first side extending along the first and second flex grooves (e.g., having a curved side wall or a sharp corner at the junction area) and a first nadir portion located along the first side adjacent the junction; and (b) a second cleat component that includes a second side extending along the first and second flex grooves (e.g., having a curved side wall or a sharp corner at the junction area) and a second nadir portion located along the second side adjacent the junction. These cleat components may be generally L-shaped, V-shaped, U-shaped, or T-shaped (with sharp corners or rounded corners) and/or elongated fin-shaped.

Sole structures in accordance with other examples of this invention may include three (or more) flex grooves that meet at a junction area. Flexible cleats, e.g., made of three (or more) cleat components, e.g., of the various types described above, may be arranged around the junction area and between such flex grooves. The cleat components may be L-shaped, T-shaped, V-shaped, U-shaped, elongated fin-shaped, etc.

Sole structures in accordance with still other examples of this invention will include flexible cleats, e.g., made of fin-shaped, T-shaped, V-shaped, U-shaped and/or L-shaped cleat components of the types described above, arranged on opposite sides of a flex groove.

BRIEF DESCRIPTION OF THE DRAWINGS

The foregoing Summary, as well as the following Detailed Description of the invention, will be better understood when considered in conjunction with the accompanying drawings in which like reference numerals refer to the same or similar elements in all of the various views in which that reference number appears. The accompanying figures include.

DETAILED DESCRIPTION

Figure 1A:
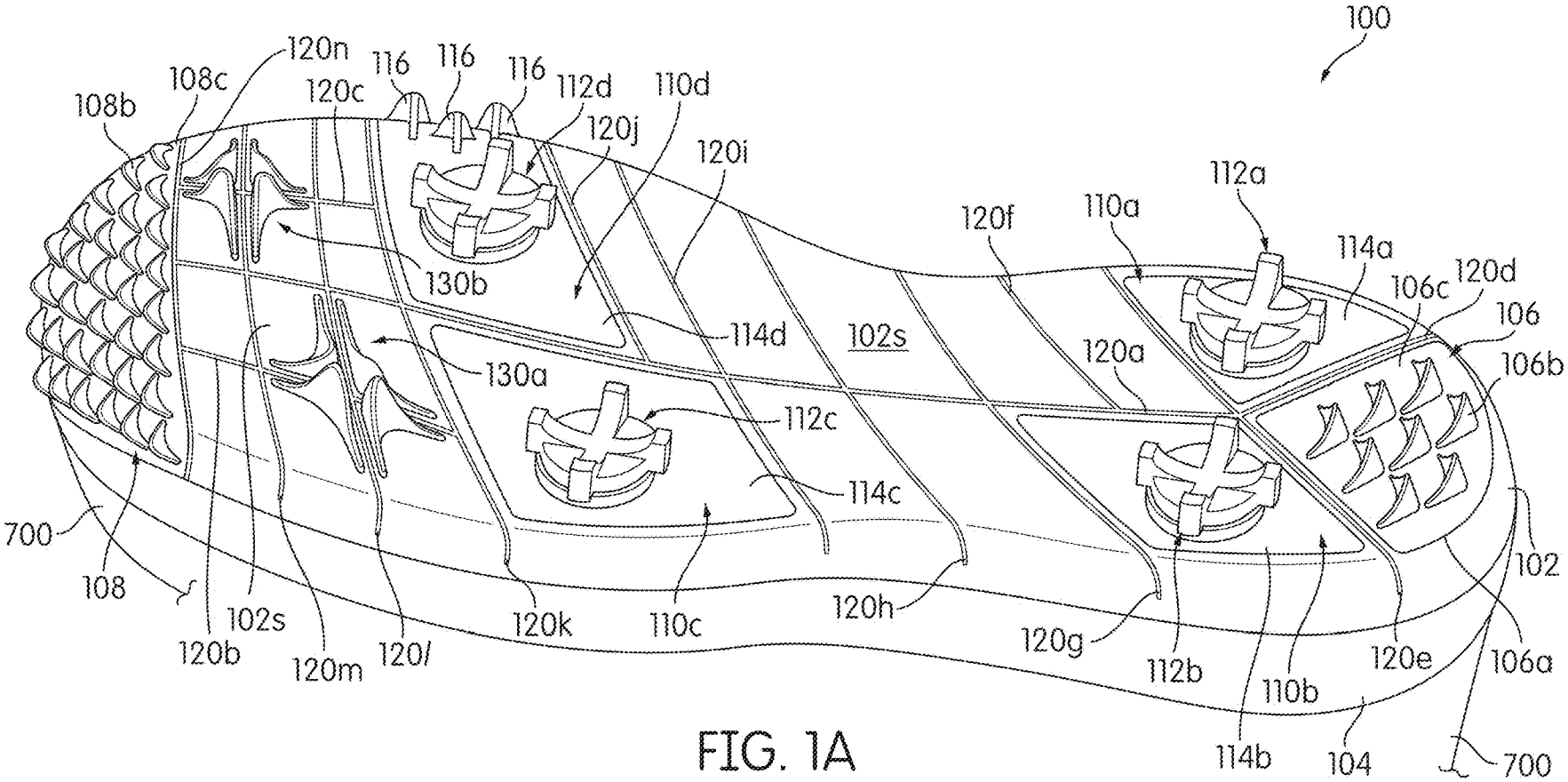
FIGS. 1A through 1H, which illustrate various features of a cleated sole structure including flexible cleats and/or an article of footwear in accordance with some examples of this invention.

In the following description of various examples of structures, components, and methods according to the present invention, reference is made to the accompanying drawings, which form a part hereof, and in which are shown by way of illustration various example structures, environments, and methods according to this invention and/or in which aspects of the invention may be practiced. It is to be understood that other structures, environments, and methods may be utilized and that structural and functional modifications may be made to the specifically described structures and methods without departing from the scope of the present invention.

I. GENERAL DESCRIPTION OF ASPECTS OF THIS INVENTION

As noted above, some aspects of this invention relate to sole structures for articles of cleated footwear that have improved flexibility (e.g., improved natural motion capabilities) and to the cleat structures included in these flexible sole structures. Such sole structures may include: (a) a sole member having an exterior surface and an opposite interior surface, wherein the sole member includes:

(1) a first flex groove that extends at least partially through the sole member from the exterior surface in a direction toward the interior surface, and (2) a second flex groove that extends at least partially through the sole member from the exterior surface in a direction toward the interior surface, wherein the first and second flex grooves form a junction; and (b) a flexible cleat extending in a direction away from the interior and exterior surfaces of the sole member, wherein the flexible cleat includes at least:

(1) a first cleat component having a first side extending along the first and second flex grooves (e.g., having a curved side wall or a sharp corner around the junction area) and a first nadir portion located along the first side adjacent the junction, and (2) a second cleat component having a second side extending along the first and second flex grooves (e.g., having a curved side wall or a sharp corner around the junction area) and a second nadir portion located along the second side adjacent the junction.

If desired, flexible cleats in accordance with this aspect of the invention may include additional cleat components, e.g., extending along the first and/or second flex grooves, and optionally including sides and/or nadir portions, e.g., of the types described above. The cleat components may be generally L-shaped, V-shaped, U-shaped, or T-shaped (with sharp corners or rounded corners) and/or elongated fin-shaped. Multiple flexible cleats of the types described above may be provided on a single sole member and/or sole structure, if desired (e.g., arranged around at least some of the same or different flex grooves provided in the sole member and/or sole structure).

The sole member described above may constitute a polymeric foam material (e.g., polyurethane foam, ethylvinylacetate foam, etc.), a rubber material, a thermoplastic polyurethane material (a "TPU"), rigid plastic materials, leather, and/or other conventional footwear midsole and/or outsole materials. The junction (and thus at least portions of the flexible cleat) may be located in a forefoot area of the sole structure (e.g., in an area supporting the first metatarsal head, the fourth and/or fifth metatarsal head(s), the big toe area, the area(s) corresponding to the fourth and/or fifth toe(s), etc.). Additionally or alternatively, if desired, junctions and/or flexible cleats of the types described above may be provided in other areas of the sole structure, such as at or near the heel area (at the lateral or medial side of a longitudinal centerline), etc.

Sole structures in accordance with some examples of this invention further may include one or more outsole components, optionally engaged with the sole member having the flexible cleat structure. If desired, the outsole component(s) may include cleat elements as well, such as fixed cleats, removable cleats, secondary traction elements, etc. The outsole component(s) in some examples of this invention may be located rearward of the flexible cleat(s) and optionally in the forefoot area beneath the first metatarsal head and/or beneath the fourth and/or fifth metatarsal head(s). The outsole component(s), which may be made from any of the materials described above for the sole member, may provide additional wear resistance and/or additional support or base structure for more durable, aggressive, and/or replaceable cleats.

The flex grooves may be sized, shaped, positioned, and/or oriented so as to provide a flexible sole structure, optionally a flexible sole structure with enhanced natural motion capabilities. In at least some examples of this invention, in an unstressed condition (i.e., without a wearer's foot or other object applying a force thereto), at least some of the flex grooves will have one or more of the following characteristics: (a) a depth of at least 3 mm (in a direction from the exterior surface toward the interior surface), and in some examples at least 5 mm, at locations adjacent the junction or intersection, (b) a width of less than 5 mm, and in some examples less than 3 mm, at locations adjacent the junction or intersection and/or between adjacent cleat components, (c) a depth that extends through at least 40% of the sole member thickness over at least 40% of the flex groove's length (optionally at the junction area), and (d) a depth that extends through at least 40% of the sole member thickness at areas between adjacent cleat components along the flex groove(s) and/or at the junction area. As some additional examples, the depth(s) may extend through at least 50%, at least 60%, or even at least 75% of the sole member thickness in at least some of the areas described above, e.g., over at least 50%, at least 60%, or even at least 75% of the flex groove's length and/or at locations adjacent one or more cleat components and/or the junction area. As still other examples, the flex groove depth in at least some areas (e.g., adjacent one or more cleat components, between two cleat components, at the junction area, in the forefoot area, along the side edges of the sole structure, etc.) may be at least 7.5 mm, at least 10 mm, or even at least 12.5 mm (e.g., over at least 40% of the flex groove's length). As yet other example features, the flex groove width in at least some areas (e.g., adjacent one or more cleat components, between two cleat components, in the forefoot area, etc.) may be less than 3 mm or even less than 2 mm (e.g., over at least 40% of the flex groove's length).

Sole structures in accordance with at least some examples of this invention may include three (or more) flex grooves that meet at a junction area. Flexible cleats, e.g., made of three (or more) cleat components, e.g., of the various types described above, may be arranged around the junction area of these three or more flex grooves.

Sole structures in accordance with some examples of this invention will include flexible cleats, e.g., made of fin-shaped, T-shaped, V-shaped, U-shaped, and/or L-shaped cleat components of the types described above, arranged on opposite sides of one or more flex grooves.

Additional aspects of this invention relate to sole structures for articles of footwear that include: (a) a sole member having a ground contacting (e.g., exterior) surface formed as an array of sole pods, including a first sole pod, a second sole pod, a third sole pod, and a fourth sole pod, wherein the first through fourth sole pods are arranged around a junction of intersecting flex grooves; (b) a first cleat component extending from the first sole pod that includes a first side extending along at least one of the intersecting flex grooves and a first nadir portion along the first side adjacent the junction; (c) a second cleat component extending from the second sole pod that includes a second side extending along at least one of the intersecting flex grooves and a second nadir portion along the second side adjacent the junction; (d) a third cleat component extending from the third sole pod that includes a third side extending along at least one of the intersecting flex grooves and a third nadir portion along the third side adjacent the junction; and (e) a fourth cleat component extending from the fourth sole pod that includes a fourth side extending along at least one of the intersecting flex grooves and a fourth nadir portion along the fourth side adjacent the junction. Such arrays of sole pods may further include: (f) a fifth sole pod, a sixth sole pod, a seventh sole pod, and an eighth sole pod, wherein the fifth through eighth sole pods are arranged around a second junction of intersecting flex grooves; (g) a fifth cleat component extending from the fifth sole pod that includes a fifth side extending along at least one of the intersecting flex grooves forming the second junction and a fifth nadir portion along the fifth side adjacent the second junction; (h) a sixth cleat component extending from the sixth sole pod that includes a sixth side extending along at least one of the intersecting flex grooves forming the second junction and a sixth nadir portion along the sixth side adjacent the second junction; (i) a seventh cleat component extending from the seventh sole pod that includes a seventh side extending along at least one of the intersecting flex grooves forming the second junction and a seventh nadir portion along the seventh side adjacent the second junction; and (j) an eighth cleat component extending from the eighth sole pod that includes an eighth side extending along at least one of the intersecting flex grooves forming the second junction and an eighth nadir portion along the eighth side adjacent the second junction. Alternatively, if desired, a junction may include fewer than four cleat components around it (e.g., from 1-3 cleat components). The array of sole pods may be provided at least in a forefoot area of the sole member (e.g., in an area supporting the metatarsal heads and/or toes of a wearer).

The array of sole pods may include at least four sole pods oriented in a lateral side to medial side direction of the sole member and at least three sole pods oriented in a heel to toe direction of the sole member, e.g., at least in the forefoot area of the sole member. More generally, if desired, the array of sole pods may include from 2-10 sole pods oriented in a lateral side to medial side direction of the sole member and from 2-6 sole pods oriented in a heel to toe direction of the sole member, e.g., at least in the forefoot area of the sole member. Also, while they may all be made as separate elements, if desired, at least some of the sole pods, including all of the sole pods of the array, may be formed as a unitary, one piece structure (e.g., connected along the interior surface of the sole member such that the flex groove(s) are formed as a cut, channel, or sipe extending partially through a thickness of the sole member).

Additional aspects of this invention relate to articles of footwear that include sole structures of the various types described above and/or to methods of making such sole structures and/or articles of footwear. As some more specific example features, the flex groove(s) may be formed in the sole structure by: (a) molding techniques (e.g., injection molding), (b) cutting using a knife or blade (e.g., hot knife cutting or siping), (c) cutting using a laser, and/or (d) direct formation (e.g., using rapid manufacturing techniques such as laser sintering). The cleat components may be integrally formed with the sole member (e.g., by molding or rapid manufacturing techniques) or may be separate elements engaged with the sole member (e.g., using cements or adhesives, mechanical connectors, in-molding techniques, cement or adhesive free connections, etc.).

Given the general description of features, aspects, structures, and arrangements according to certain embodiments of the invention provided above, a more detailed description of specific example structures and methods in accordance with this invention follows.

II. DETAILED DESCRIPTION OF EXAMPLE STRUCTURES AND METHODS ACCORDING TO THIS INVENTION

Referring to the figures and following discussion, various articles of footwear, footwear components, and/or features thereof in accordance with the present invention are described. The footwear depicted and discussed are golf shoes, but the concepts disclosed with respect to various aspects of this invention may be applied to a wide range of cleated or other athletic and non-athletic footwear styles, including, but not limited to: soccer shoes, baseball shoes, softball shoes, football shoes, etc.

FIGS. 1A through 1H provide various views of example sole structures 100 and features thereof in accordance with some aspects of this invention. In this illustrated example, the sole structure 100 includes a sole member 102 for supporting a wearer's foot. The sole member 102 may be constructed from any desired material without departing from this invention, including conventional materials used in footwear sole construction, such as polymeric foam materials (e.g., polyurethane foams, ethylvinylacetate foams, etc.), rubber materials (natural or synthetic), thermoplastic polyurethane materials, other rigid plastic materials, leather, and the like. The sole structure 100 further may include an additional midsole component 104, e.g., made from a polymeric foam material (e.g., polyurethane foams, ethylvinylacetate foams, etc.), which may be located exterior to (as shown in FIG. 1A) or within an upper 700 of the shoe. If desired, when both the sole member 102 and midsole component 104 are present and made from a polymeric foam material, the foam material of the lower sole member 102 may be made from a harder and/or more durable polymeric foam material (at least in some regions) as compared to that of the midsole component 104. The sole member 102 and the midsole component 104 may be made in any desired manners without departing from this invention, including through molding processes (e.g., injection molding, compression molding, etc.), through rapid manufacturing additive fabrication processes, etc. Different areas of the sole member 102 and/or the midsole component 104 may be made to have different characteristics, such as different hardnesses, thicknesses, wear resistance, abrasion resistance, density, colors, aesthetic features, etc.

If desired, rather than being formed of two separate pieces that are engaged together (e.g., by cements, adhesives, mechanical connectors, etc.), sole member 102 and midsole component 104 may be made as a unitary, single piece structure, e.g., by molding (optionally using dual density foam injection molding techniques), rapid manufacturing additive fabrication processes, etc. Sole member 102 and/or midsole component 104 (when present) may provide the primary impact force attenuation features of the overall footwear and/or sole structure 100.

The illustrated sole structure 100 is a cleated sole structure, e.g., for use in golf or other activities (e.g., athletic activities, such as baseball, softball, football, soccer, etc.). The rear heel area of this example sole structure 100 includes traction enhancing component 106. This traction enhancing component 106 may be made from a harder material than sole member 102, and it may constitute an outsole component that is engaged within a recess or opening 106*a* formed in the heel area of the sole member 102 (e.g., engaged via cements or adhesives, mechanical connectors, etc.). In this illustrated example, the rear heel traction enhancing component 106 includes a plurality of raised, directional traction elements 106*b* (extending away from base surface 106*c*). At least some of the directional traction elements 106*b* of this example include a convex wall facing the rear of the sole structure 100 and an opposite concave wall facing the front of the sole structure 100 (e.g., to form a generally parabolic or otherwise curve shaped traction element structure 106*b*). The concave forward facing wall of these directional traction elements 106*b* provides an enlarged surface or pocket for engaging the ground as the wearer walks on downhill terrain (when more weight is generally placed on the heel area of the sole structure 100 as the wearer leans rearward). The base surface 106*c* of this example traction enhancing component 106 is generally triangular shaped. Other styles, shapes, sizes, numbers, and/or arrangements of traction enhancing element structures 106*b* may be used in the heel area, including different types of directional traction elements, without departing from this invention.

The forward toe area of this example sole structure 100 includes traction enhancing component 108. This traction enhancing component 108 also may be made from a harder material than sole member 102, and it may constitute an outsole component or a toe cap type element that is incorporated into the overall sole structure 100 of the article of footwear (e.g., engaged with sole member 102, midsole component 104, and/or an upper 700 of the footwear article via cements or adhesives, mechanical connectors, etc.; fit into an opening or recess in sole member 102 and/or midsole component 104; etc.). As shown, the base surface 108*c* of this traction component 108 may extend around the side surfaces of the toe area, e.g., to provide improved wear resistance around the toe area. In this illustrated example, the forward toe traction enhancing component 108 includes a plurality of raised, directional traction elements 108*b* (extending away from base surface 108*c*). At least some of the directional traction elements 108*b* of this example include a convex wall facing the front of the sole structure 100 and an opposite concave wall facing the rear of the sole structure 100 (e.g., to form a generally parabolic or otherwise curve shaped traction element structure 108*b*). The concave rear facing wall of these directional traction elements 108*b* provides an enlarged surface or pocket for engaging the ground as the wearer walks on uphill terrain (when more weight is generally placed on the toe area of the sole structure 100 as the wearer leans forward). Other styles, shapes, sizes, numbers, and/or arrangements of traction enhancing element structures 108*b* may be used in the toe area, including different types of directional traction elements, without departing from this invention.

The sole structure 100 of this example further includes traction enhancing components 110*a*, 110*b*, 110*c*, and 110*d* that include cleat elements 112*a*, 112*b*, 112*c*, and 112*d*, respectively. The cleat elements 112*a*, 112*b*, 112*c*, and 112*d* of this example may be permanently fixed with respect to their respective base members 114*a*, 114*b*, 114*c*, and 114*d* (e.g., by molding, in-molding, rapid manufacturing additive fabrication techniques, or the like) or they may be removably engaged with respect to their respective base members 114*a*, 114*b*, 114*c*, and 114*d* (e.g., by conventional releasable cleat engagement structures, such as threaded connectors, turnbuckle type connectors, etc.). The structure for engaging the removable cleat elements 112*a*, 112*b*, 112*c*, and 112*d* may be provided as part of the base members 114*a*, 114*b*, 114*c*, 114*d*, as part of the sole member 102, and/or as part of another component of the sole structure 100 and/or the article of footwear. In this illustrated example, the traction enhancing components 110*a*, 110*b*, 110*c*, 110*d* constitute outsole components that are engaged in recesses or openings formed in the sole member 102 (e.g., by cements, adhesives, mechanical connectors, etc.). The cleat elements 112*a*, 112*b*, 112*c*, 112*d* are removable cleats having threaded posts or turnbuckle connectors that engage with threaded holes or corresponding turnbuckle connectors included with the base members 114*a*, 114*b*, 114*c*, 114*d*. The sole member 102 includes appropriate recesses or openings to accommodate the releasable connector structures for the removable cleats 112*a*, 112*b*, 112*c*, 112*d*. Base members 114*a*, 114*b*, 114*c*, and/or 114*d* may constitute plate like units (e.g., harder than the sole member 102 material) that are engaged within recesses or openings formed in the sole member 102 (e.g., fixed to the sole member 102 using adhesives, cements, mechanical connectors, etc.).

While other numbers and/or arrangements of cleat elements are possible, this example sole structure 100 includes just four removable cleat members 112*a*, 112*b*, 112*c*, 112*d*. The center of rearmost cleat element 112*a* is located on the medial (inside) of the rear heel area of the sole structure 100. A second heel cleat element 112*b* has its center located forward of the center of rearmost heel cleat element 112*a*, and the center of this second heel cleat element 112*b* is located on the lateral side (outside) of the sole structure 100. In this illustrated example, heel cleat elements 112*a* and 112*b* (as well as their associated base members 114*a* and 114*b*) are located on opposite sides of a generally longitudinally extending flex groove 120*a*.

Two removable cleats 112*c* and 112*d* also are provided in the forefoot area (e.g., beneath the metatarsal head areas of a wearer's foot). The center of cleat element 112*c* is located on the lateral (outside) of the forefoot area of the sole structure 100, and the center of cleat element 112*d* optionally is located slightly forward of the center of cleat element 112*c*. The center of cleat element 112*d* is located on the medial side (inside) of the sole structure 100. Cleat element 112*c* may be positioned to support the metatarsal head of the fourth and/or fifth (smaller) toes, and cleat element 112*d* may be positioned to support the metatarsal head of the first (big) toe. In this illustrated example, forefoot cleat elements 112*c* and 112*d* (as well as their associated base members 114*c* and 114*d*) are located on opposite sides of a generally longitudinally extending flex groove 120*a*, which may be separate from or continuous with the longitudinal flex groove 120*a* described above with respect to the rear heel cleat elements 112*a* and 112*b* (if any).

Figure 1B:
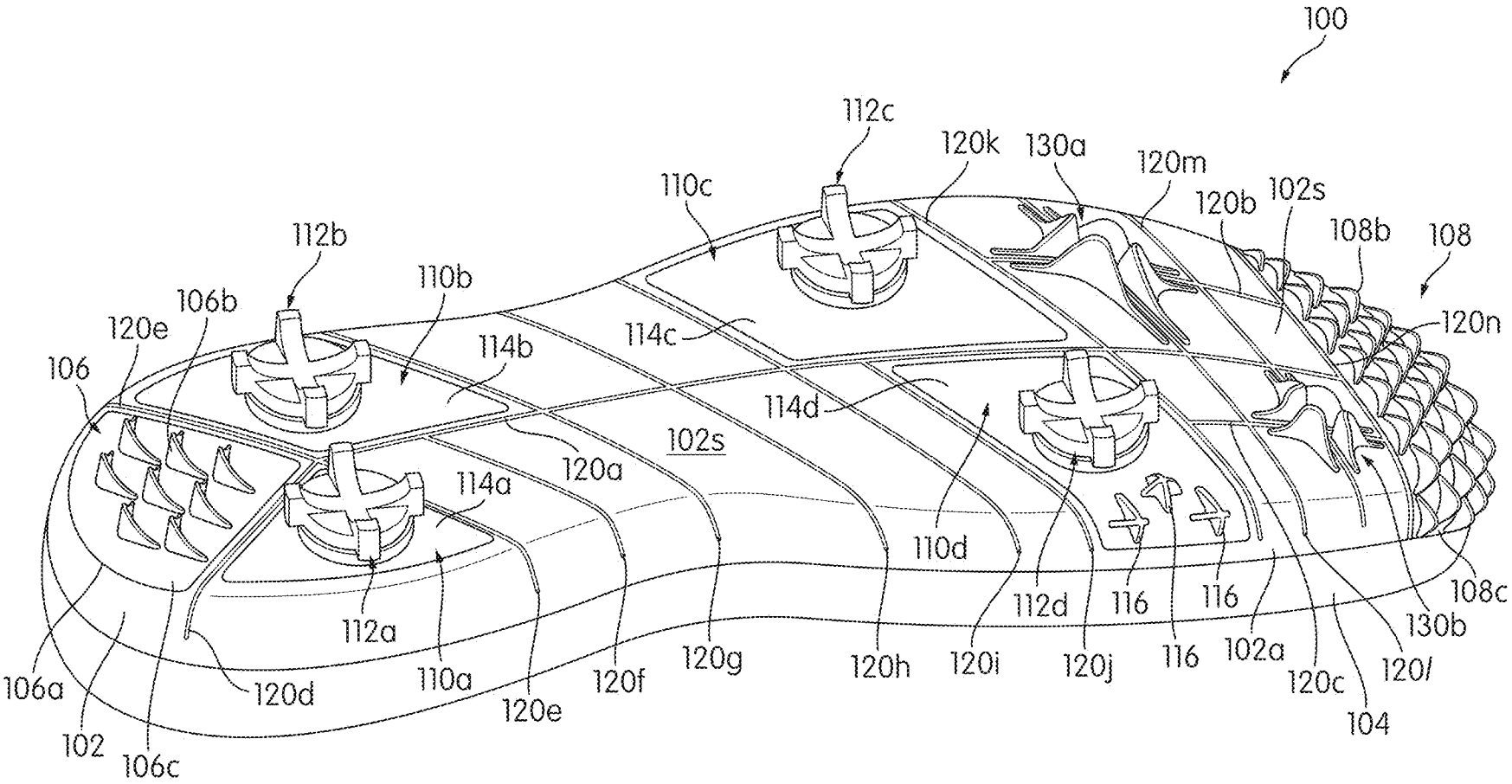
Figure 1C:
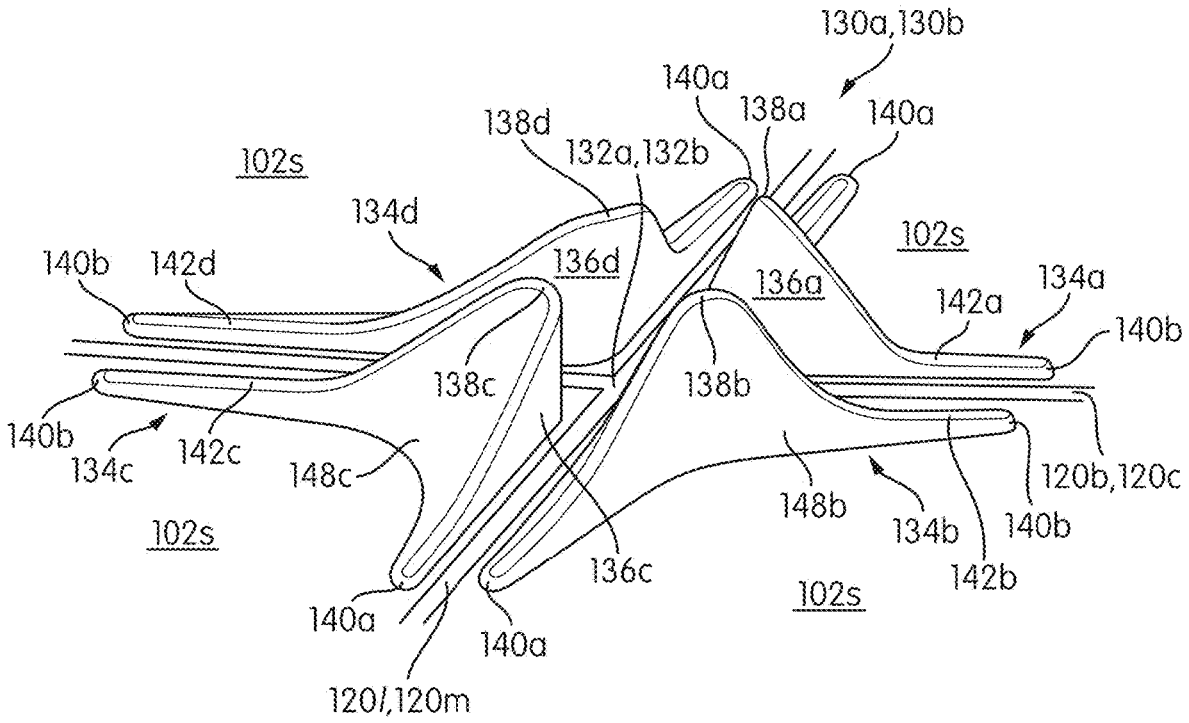
Figure 1D:
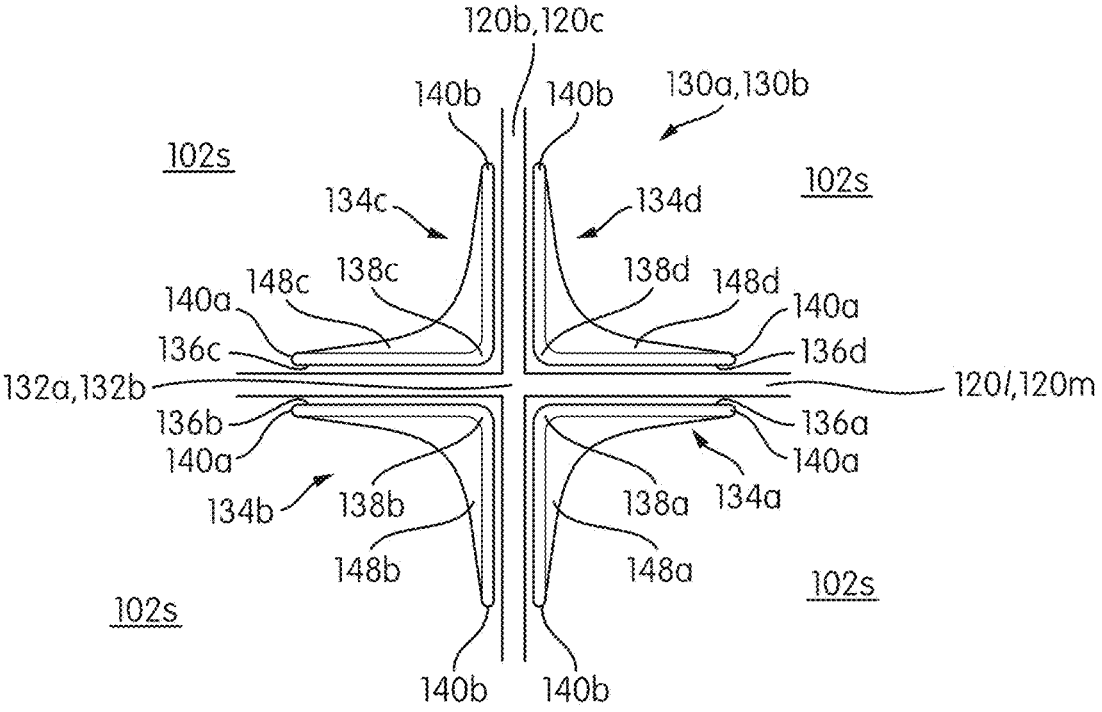

In this illustrated example, the base member 114*d* of the medial forefoot traction enhancing component 110*d* wraps upward and around at least a portion of a medial side edge of the sole structure 100 (e.g., at area 102*a* of sole member 102, as shown in FIG. 1B). One or more traction enhancing elements 116 are provided at and along this side area of traction enhancing component 110*d*, and one or more of these traction enhancing elements 116 may project at least partially in a sideways direction (e.g., in a sideways direction beyond the edge 102*a* of sole member 102 and/or beyond the base surface of traction enhancing component 110*d*). The side edge located and/or oriented traction enhancing elements 116 provide additional support and traction, particularly during the downswing and/or ball contacting phases of a golf swing, e.g., as the club head is nearing and passing through the ball contact zone, and/or during other activities (e.g., when making a turn or cut). Side traction elements 116 may be fixed to and optionally formed as an integral structure with base member 114*d*, or they may be removably engaged with the base member 114*a*, the sole member 102, or other portion of the sole and/or footwear structure.

This example sole structure 100 also includes enhanced flexibility and/or natural motion capabilities, and various traction element features and flexibility/natural motion enhancing features of this example sole structure 100 will be described in more detail below. Some enhanced flexibility is provided by forming much of the sole structure 100 from a flexible material and/or a flexible construction. For example, the sole member 102 may be made, at least in part, from a polymeric foam material that supports all or substantially all of a plantar surface of wearer's foot. As another potential feature shown in FIGS. 1A and 1B, flex grooves are formed in the sole member 102 to enhance the flexibility of the sole structure 100 (which can provide enhanced flexibility even if sole member 102 is formed of rubber, TPU, and/or other rigid materials). While other flex groove structures and arrangements are possible without departing from this invention (including arrangements with more or fewer flex grooves and/or longer or shorter flex grooves), this illustrated example sole member 102 includes the following flex grooves:

(a) central longitudinal flex groove 120*a* (e.g., extending from a heel area to a toe area of the sole member 102 in this illustrated example, but is preferably provided at least in a forefoot area of the sole member 102);

(b) lateral forefoot longitudinal flex groove 120*b*, optionally substantially parallel with flex groove 120*a* at the forefoot area (e.g., extending between traction element 110*c* and traction element 108);

(c) medial forefoot longitudinal flex groove 120*c*, optionally substantially parallel with flex groove 120*a* at the forefoot area (e.g., extending between traction element 110*d* and traction element 108);

(d) rear heel flex groove 120*d* (e.g., extending from flex groove 120*a* to the rear heel area of the sole member 102 (optionally more toward the medial side than the lateral side) and/or between (e.g., separating) traction elements 110*a* and 106);

(e) rear heel transverse flex groove 120*e* (e.g., extending across the sole member 102 from the medial side to the lateral side, between (e.g., separating) traction elements 110*b* and 106, and/or along the forward edge of traction element 110*a*); flex groove 120*e* may have a straight configuration or may be curved or angled (e.g., at the junction with longitudinal flex groove 120*a*);

(f) central heel transverse flex groove 120*f* (e.g., extending from longitudinal flex groove 120*a* and/or traction element 110*b* to the medial side of sole member 102);

(g) forward heel transverse flex groove 120*g* (e.g., extending across the sole member 102 from the medial side to the lateral side, forward of traction element 110*b*, and/or along the front edge of traction element 110*b*);

(h) arch transverse flex groove 120*h* (e.g., extending across the sole member 102 in the arch area from the medial side to the lateral side of sole member 102);

(i) first forefoot transverse flex groove 120*i* (e.g., extending across the sole member 102 from the medial side to the lateral side, rearward of the traction element 110*c*, and/or along a rear edge of traction element 110*c*);

(j) second forefoot transverse flex groove 120*j* (e.g., extending from flex groove 120*a* and/or traction element 110*c* and/or along the rear edge of traction element 110*d*);

(k) third forefoot transverse flex groove 120*k* (e.g., extending across the sole member 102 from the medial side to the lateral side, along the forward edge of traction element 110*c*, and/or along the forward edge of traction element 110*d*);

(l) fourth forefoot transverse flex groove 120*l* (e.g., extending across the sole member 102 from the medial side to the lateral side); and (m) fifth forefoot transverse flex groove 120*m* (e.g., extending across the sole member 102 from the medial side to the lateral side).

If desired, another transverse flex groove (120*n*) may be provided along the rear edge of traction element 108 at the forward toe area of the sole member 102.

Figure 1E:
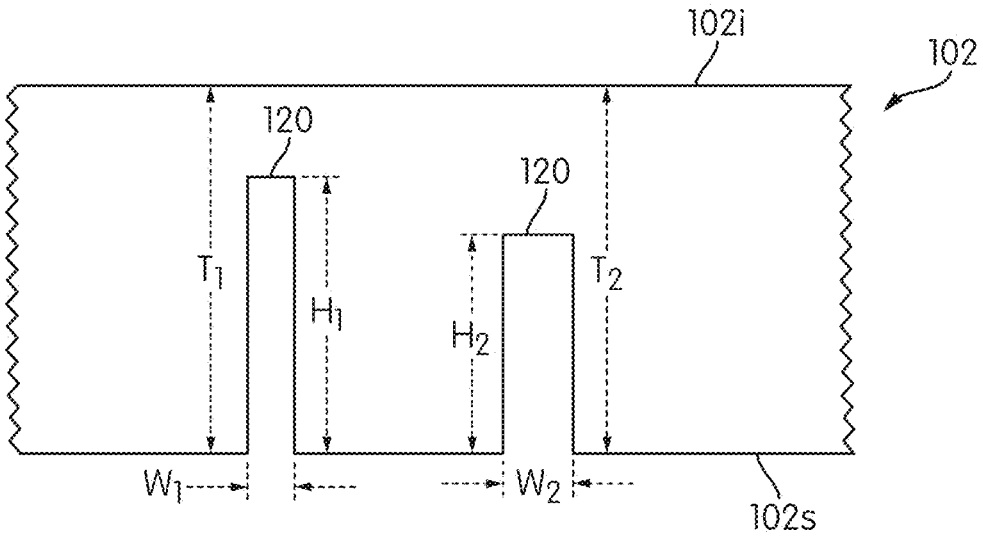
Figure 1F:
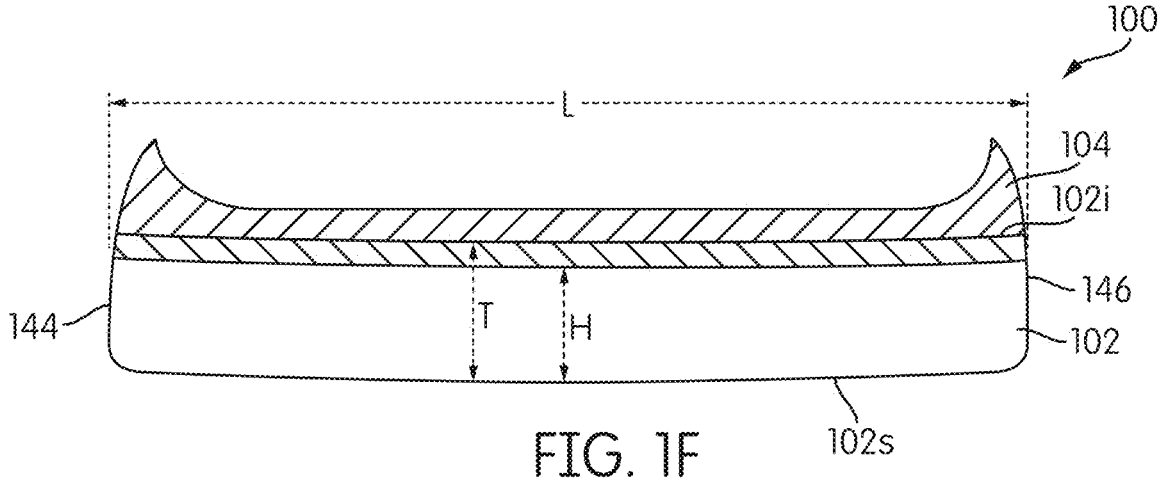
Figure 1G:
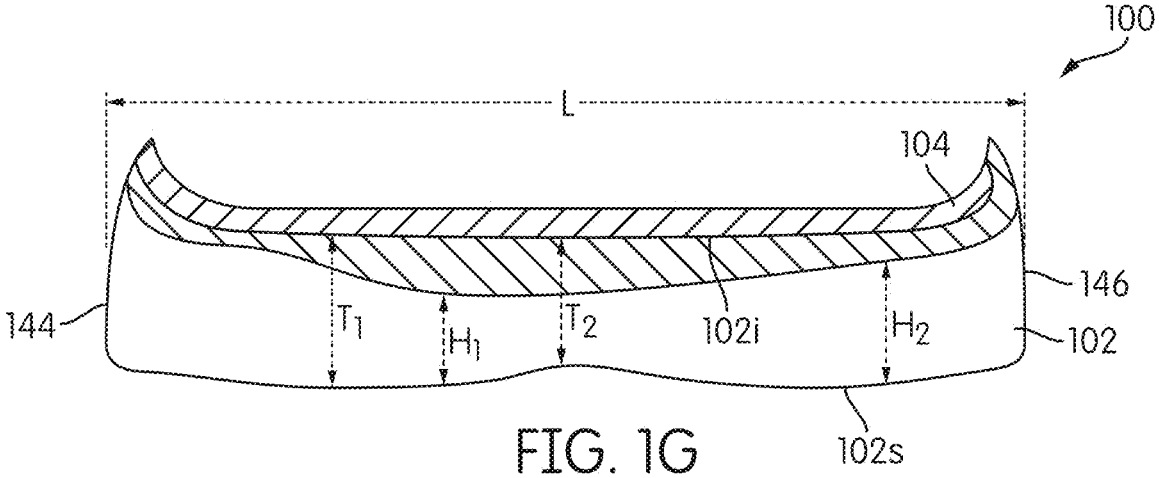
Figure 1H:
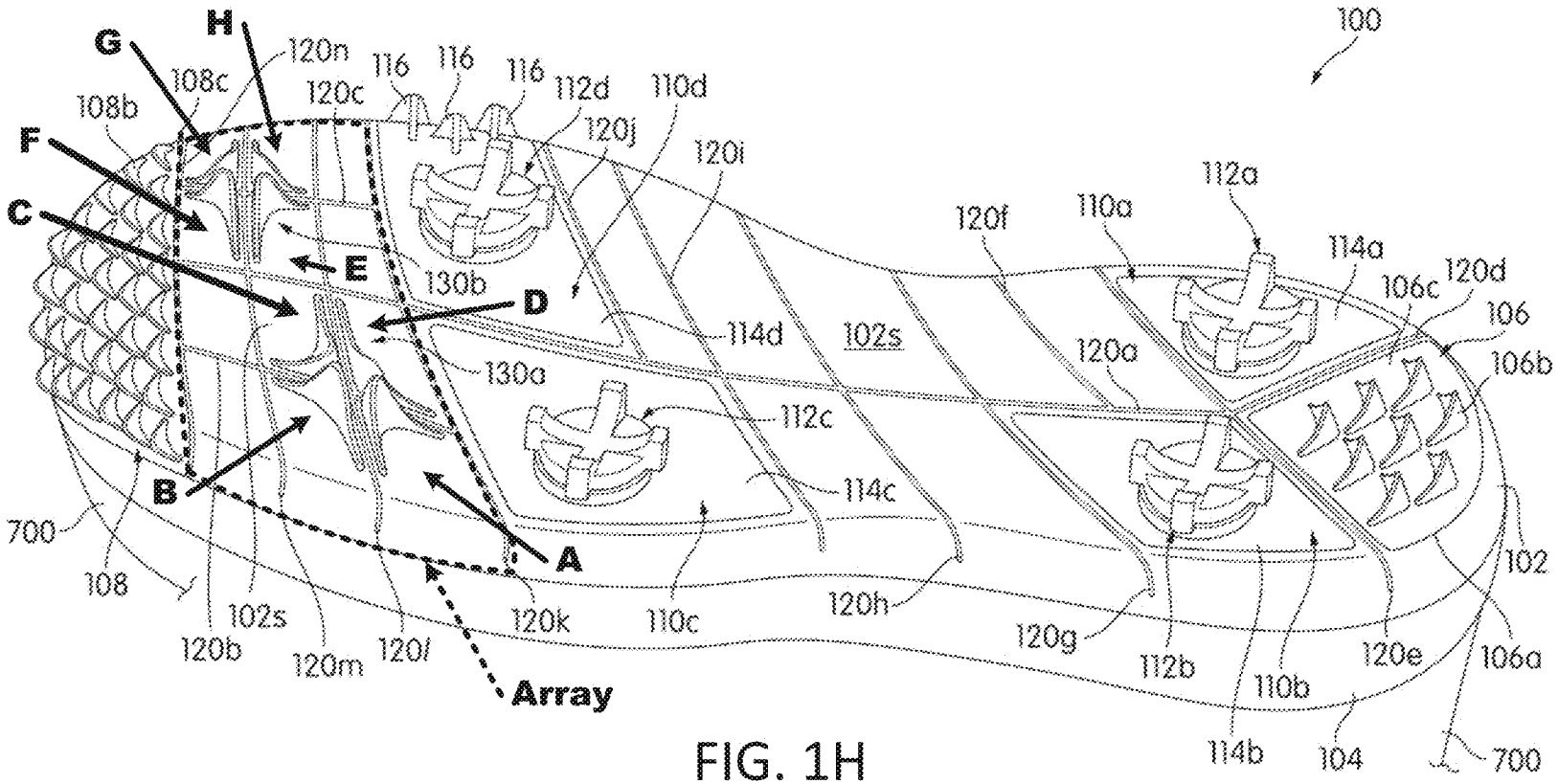

The pattern of intersecting flex grooves in this illustrated example forms an array of sole portions or sole pods located between the adjacent flex grooves (and/or other features of the sole structures), e.g., as best shown in FIG. 1H. This "array" type construction helps maintain closer ground contact for the foot and sole during motion (e.g., during activities causing plantar-flexion). In this illustrated example, the forefoot area (and the area surrounding the two flexible cleats 130*a* and 130*b*) constitutes a 4×3 array of sole portions or pods located around flex grooves 120*a*, 120*b*, 120*c*, 120*k*, 1201, and 120*m*. Note, for example, pods A, B, C, and D around flexible cleat 130*a* and pods E, F, G, and H around flexible cleat 130*b* in FIG. 1H. More or fewer flex grooves may be provided in the forefoot area, if desired, to produce different sized and/or shaped "arrays" of sole portions or pods in the forefoot area (and the area surrounding any one or more forefoot flexible cleats). Such forefoot area arrays may have, for example, from 2 to 10 sole pods in the side-to-side direction and from 2 to 6 sole pods in the heel-to-toe direction. The "forefoot area," as used herein in this context, means the area of a sole structure or an article of footwear located forward of the arch support area and located so as to support areas of the foot from the metatarsal heads and forward (including the toes).

The flex grooves may be straight, curved, and/or angled without departing from this invention. In some examples, the flex grooves may be arranged and located at appropriate positions so as to promote natural flexion for a wearer's foot during use (e.g., as the user's weight shifts when landing a step or jump, as the user's weight shifts during the course of a golf swing (or other athletic activity, such as when swinging at a baseball or other object, when throwing a ball or other object, when making a turning or cutting maneuver, etc.). As yet another potential feature, if desired, the flex grooves on one shoe (e.g., location, sizes, shapes, orientations, etc.) may be different from the flex grooves on the other shoe of a pair (e.g., different for right or left handed athletes, to better support weight shift on the two feet during various athletic activities, etc.).

More or fewer flex grooves from those specifically described above may be provided in a sole structure 100 without departing from this invention. Additionally, some of the illustrated flex grooves may be changed into shorter, longer, and/or multiple (separated) segments. Also, while the illustrated example shows flex grooves only in the sole member 102, if desired, flex grooves may be provided in traction element components 106, 108, 110*a*, 110*b*, 110*c*, and/or 110*d* and/or to separate these traction element components into multiple parts without departing from this invention. In the illustrated example of FIGS. 1A and 1B, flex grooves are located so as to lie immediately adjacent at least some portion (e.g., at least 65% of a perimeter) of base members 114*a*-114*d* of traction element components 110*a*-110*d*. In this specific illustrated example, each base member 114*a*-114*d* has at least 65% of its perimeter located immediately adjacent a flex groove (with only the extreme side edges of the base members 114*a*-114*d* not having an immediately adjacent flex groove). This arrangement provides more flexibility and more natural motion capability to the sole structure 100 at areas immediately surrounding the base members 114*a*-114*d*, which may be made from a somewhat harder or stiffer material than that of sole member 102 (to better support cleats 112*a*-112*d*).

This illustrated example sole structure 100 includes further features to enhance its flexibility. As shown in FIGS. 1A and 1B, some of the flex grooves of sole member 102 are arranged such that they divide some of the sole structure's traction elements into multiple (separated) component parts. Example features and structures of these "flexible cleat" traction elements 130*a* and 130*b* will be described in more detail below, additionally in conjunction with FIGS. 1C through 1G.

While they may be provided in more, fewer, and/or other locations in an overall sole structure 100 (including in the heel area), in this illustrated example, two flexible cleats 130*a* and 130*b* (and their respective junctions areas 132*a*, 132*b*, as will be described in more detail below) are provided in the forefoot area of the sole member 102, with one flexible cleat 130*a* (and/or its junction area 132*a*) located at the lateral side of the sole member 102 (and the lateral side of longitudinal flex groove 120*a* and/or below the outside toe(s)) and the other flexible cleat 130*b* (and/or its junction area 132*b*) located at the medial side of the sole member 102 (and the medial side of longitudinal flex groove 120*a* and/or beneath the inside toe(s)). Providing the flexible cleats 130*a* and 130*b* in these areas further improves flexibility of the overall sole structure 100, e.g., particularly during toe off phases of a step or jump and/or during the downswing portions of a golf swing or other athletic activities (e.g., when the athlete is engaging the ground and/or pushing off with his or her toes), during the ball contact or later phases of a golf swing cycle, etc.

The flexible cleats 130*a* and/or 130*b* may be integrally formed with and extend from an exposed exterior surface 102*s* of the sole member 102 (e.g., the flexible cleats 130*a*, 130*b* may be formed during a molding process for forming the sole member 102 and/or in a rapid manufacturing additive fabrication process). Because the illustrated flexible cleats 130*a* and 130*b* of this example have similar structures (albeit potentially with somewhat different sizes and/or shapes), the structure of flexible cleat 130*a* will be described in more detail below. Those skilled in the art will understand that flexible cleat 130*b* may have similar structures, features and/or properties.

As described above, the sole member 102 includes: (a) a first flex groove (e.g., longitudinal flex groove 120*b*) that extends at least partially through a thickness of the sole member 102 from its exterior surface 102*s* in a direction toward its interior surface and (b) a second flex groove (e.g., transverse flex groove 120*l*) that extends at least partially through the sole member 102 from its exterior surface 102*s* in a direction toward its interior surface. These first and second flex grooves 120*b* and 120*l* meet to form a junction (e.g., intersection 132*a*). When formed as an intersection 132*a*, the flex grooves 120*b* and 120*l* may meet at any desired angle without departing from this invention. In some more specific examples, the flex grooves 120*b*, 1201 may meet at angles ranging from 20° to 160°, and in some examples, between angles ranging from 30° to 150° and even between 45° and 135°. The flex grooves 120*b*, 1201 also may be straight or curved.

The flexible cleat 130*a* is formed around intersection 132*a*. Flexible cleat 130*a* extends in a direction away from the interior and exterior surfaces of the sole member 102, and in this illustrated example, the flexible cleat 130*a* includes: (a) a first cleat component 134*a* that includes a first side or wall 136*a* extending along the flex grooves 120*b* and 120*l* and a first nadir portion 138*a* located along the first side 136*a* adjacent the intersection 132*a*; (b) a second cleat component 134*b* that includes a second side or wall 136*b* extending along the flex grooves 120*b*, 1201 and a second nadir portion 138*b* located along the second side 136*b* adjacent the intersection 132*a*; (c) a third cleat component 134*c* that includes a third side or wall 136*c* extending along the flex grooves 120*b*, 1201 and a third nadir portion 138*c* located along the third side 136*c* adjacent the intersection 132*a*; and (d) a fourth cleat component 134*d* that includes a fourth side or wall 136*d* extending along the flex grooves 120*b*, 1201 and a fourth nadir portion 138*d* located along the fourth side 136*d* adjacent the intersection 132*a*. Flexible cleat 130*b* of this illustrated example includes a similar four part flexible cleat component structure 134*a*, 134*b*, 134*c*, 134*d* arranged along longitudinal flex groove 120*c* and transverse flex groove 120*m* and at the junction 132*b* between these flex grooves 120*c*, 120*m* (e.g., with one cleat component provided within each quadrant or sector defined around the junction 132*b*).

The sides or walls 136*a*, 136*b*, 136*c*, and 136*d* of the flexible cleat components 134*a*-134*d* may constitute interior walls or edges that extend downward from the base surface 102*s* and face the flex grooves 120*b*, 120*c*, 1201, and/or 120*m*. While these walls or sides 136*a*, 136*b*, 136*c*, 136*d* may be straight or curved and may extend downward from the base surface 102*s* at any desired angle or direction, in some examples, they will extend downward such that the base surface 102*s* and the interior surface of the walls or sides 136*a*, 136*b*, 136*c*, 136*d* (adjacent the flex grooves) form an angle of 90° to 135° (and in some examples, an angle from 90° to 125° or even from 90° to 110°). The interior walls or sides 136*a*, 136*b*, 136*c*, 136*d* that face the flex grooves may form a smoothly curved surface or a more abrupt (substantially vertical) corner (or multiple corners) at locations at or near the intersections 132*a*, 132*b* (with smoothly curved walls extending along the flex grooves being shown in the illustrated example of FIGS. 1A through 1D). In the illustrated examples, the interior walls or sides 136*a*-136*d* of the flexible cleat components 134*a*-134*d* that face the flex grooves extend continuously from a first end 140*a* of the respective cleat component (located adjacent one of the flex grooves) to a second end 140*b* of the respective cleat component (located adjacent the other flex groove making up the intersection), and the respective nadir portions 138*a*-138*d* of the cleat components are located between the first end 140*a* and the second end 140*b* of the respective cleat component 134*a*-134*d* (optionally at or near the junction).

FIGS. 1E through 1G show additional potential features of flex grooves 120*a*-120*n* that may be included in sole structures (e.g., in sole members 102) in accordance with at least some examples of this invention. FIG. 1E illustrates an enlarged view of a portion of potential flex grooves 120, and FIGS. 1F and 1G show example cross sectional views cut through and parallel to a groove 120 (e.g., from a lateral side 144 to a medial side 146 of a sole structure 100). As noted above, at least some of the flex grooves 120*a*-120*n* may be sized, shaped, positioned, and/or oriented so as to provide a flexible sole structure, optionally a sole structure with enhanced natural motion capabilities (e.g., with flexibility to enhance natural movement to support steps, jumps, golf swings, and other athletic movements). For example, at least some of these flex grooves 120*a*-120*n* (optionally, including those around the flexible cleats 130*a*, 130*b*), in an unstressed condition (e.g., with the sole or a shoe containing the sole sitting freely on horizontal surface), may have one or more of the following characteristics:

(a) a depth (H, $H_1$, $H_2$) of at least 3 mm (in a direction from the exterior surface 102*s* toward the interior surface 102*i* of the sole member 102), and in some examples at least 5 mm, optionally at least at locations adjacent the junction or intersection 132*a*, 132*b* and/or adjacent the sides 136*a*-136*d;*

(b) a width ($W_1$, $W_2$) of less than 5 mm (and in some examples less than 3 mm), optionally at least at locations adjacent the junction or intersection 132*a*, 132*b* and/or adjacent the sides 136*a*-136*d;*

(c) a depth (H, $H_1$, $H_2$) that extends through at least 40% of the sole member 102 thickness (T, $T_1$, $T_2$) (e.g., H≥0.4 T) over at least 40% of the flex groove's length L (and in some examples, H≥0.5 T);

(d) a depth (H, $H_1$, $H_2$) that extends through at least 40% of the sole member 102 thickness (T, $T_1$, $T_2$) (e.g., H≥0.4 T) throughout the areas between adjacent cleat components 134*a*-134*d* (and in some examples, H≥0.5 T);

(e) a depth (H, $H_1$, $H_2$) in at least some areas along the longitudinal length L of the flex groove 120 (e.g., adjacent one or more cleat components 134*a*-134*d*, between two cleat components, in the forefoot area, etc.) of at least 3 mm, at least 5 mm, at least 7.5 mm, at least 10 mm, or even at least 12.5 mm;

(f) a width ($W_1$, $W_2$) in at least some areas along the longitudinal length L of the flex groove 120 (e.g., adjacent one or more cleat components 134*a*-134*d*, between two cleat components, in the forefoot area, etc.) of less than 5 mm, less than 3 mm, or even less than 2 mm; and (g) a groove width to depth ratio (W/H) of less than 1, and in some examples, less than 0.75, less than 0.5, and even less than 0.3, optionally at least at some locations adjacent the junction or intersection 132*a*, 132*b*, adjacent the sides 136*a*-136*d* of cleat components 134*a*-134*d*, and/or between adjacent sides 136*a*-136*d*.

As some additional examples, the depth (H, $H_1$, $H_2$) may extend through at least 50%, at least 60%, or even at least 75% of the sole member 102 thickness (T, $T_1$, $T_2$) in at least some areas, e.g., over at least 40%, at least 50%, at least 60%, or even at least 75% of the flex groove's length L.

FIGS. 1E-1G further illustrate that the groove widths W and groove depths H in a given sole member 102 may differ without departing from this invention (although, if desired, each groove may have the same width and depth characteristics). Additionally, while FIG. 1F shows a groove 120 having a substantially constant depth H and a sole member 102 having a substantially constant depth to thickness ratio (H/T) along substantially the entire longitudinal length L of the groove 120, this is not a requirement. Rather, as shown in FIG. 1G, the groove depth H and/or the overall sole member thickness T may vary over the course of the longitudinal length L of a groove structure (from the lateral side 144 to the medial side 146 of the sole member 102). Groove width W also may vary along the longitudinal length L of a given groove.

As illustrated in FIGS. 1A-1D, the flexible cleats 130*a*, 130*b* constitute four "fin-type" cleat components 134*a*-134*d* arranged around a junction or intersection 132*a*, 132*b* of two flex grooves. Each cleat component 134*a*-134*d* includes a relatively thin bottom edge 142*a*-142*d*, respectively, that is arranged to contact the ground, and this thin bottom edge 142*a*-142*d* may penetrate the ground surface under weight from the wearer's foot. These bottom edges 142*a*-142*d* may be less than 2 mm wide at their exposed, ground contacting edge, and in some examples, less than 1 mm or even less than 0.5 mm wide. The bottom edges 142*a*-142*d* also may form a point or sharp corner with the point or corner oriented to contact the ground in use. The edges 142*a*-142*d* may slope (in a straight or curved path) from their free ends 140*a*, 140*b* to their respective nadir locations 138*a*-138*d*. The cleat components 134*a*-134*d* may get somewhat thicker moving from the bottom edges 142*a*-142*d* toward the sole base surface 102*s*. Also, the interior walls 136*a*-136*d* may form a sharper curve or corner as compared to the opposite exposed walls 148*a*-148*d*. The base of exposed walls 148*a*-148*d* at the sole base surface 102*s* may form a generally circular arc or parabolic path from one end 140*a* to the opposite end 140*b*.

The flexible cleats may have any desired sizes or dimensions without departing from this invention. For forefoot type flexible cleats 130*a*, 130*b* of the type described above, the cleat component 134*a*-134*d* height at its nadir point 138*a*-138*d* or largest dimension (from and in a direction away from the sole base surface 102*s*, $H_{Cleat}$) may be at least 2 mm (e.g., in the range of 2 mm to 12 mm), and in some examples, at least 3 mm high, or even at least 4 mm high. In some sole structures in accordance with this invention, the ratio of cleat component height at its nadir point or largest downward dimension (from and in a direction away from the sole base surface 102*s*), $H_{Cleat}$, to groove depth (from the sole base surface 102*s* and in a direction into the sole member 102, $H_{Groove}$) at the junction area or in at least a portion of an area of the groove immediately adjacent the cleat component will be as follows: $H_{Cleat}$:$H_{Groove}$≤1.5, and in some examples, $H_{Cleat}$:$H_{Groove}$≤1.25 and even $H_{Cleat}$:$H_{Groove}$≤1.

Figure 2A:
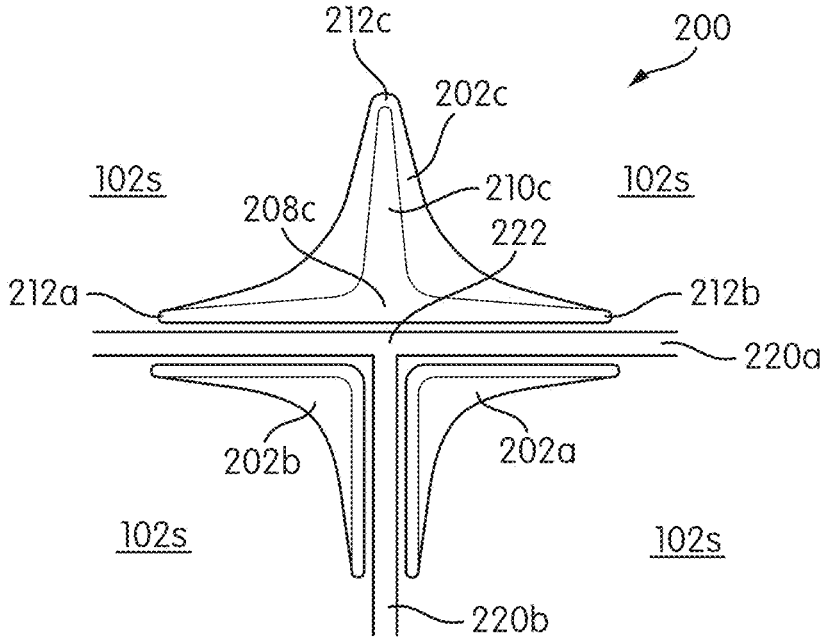
FIGS. 2A and 2B, which illustrate another example flexible cleat structure in accordance with this invention.
Figure 2B:
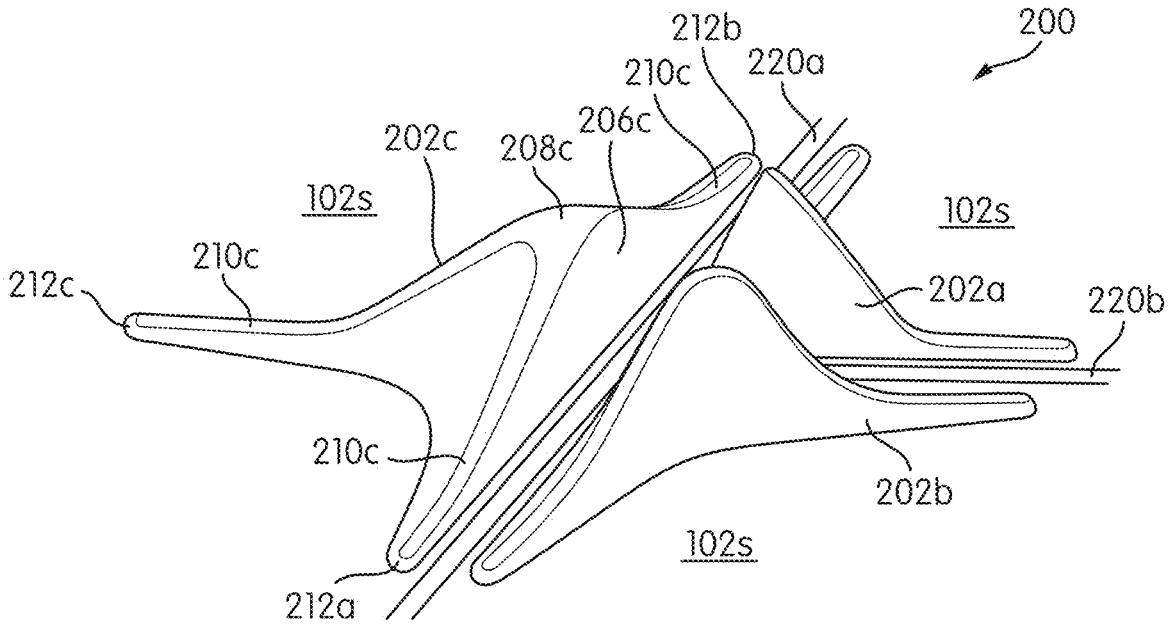

The example flexible cleats 130*a*, 130*b* shown in FIGS. 1A-1G have four "fin-type" cleat components 134*a*-134*d* arranged around an intersection 132*a*, 132*b* of two flex grooves (e.g., with one separate cleat component provided in each quadrant or sector around the intersection 132*a*, 132*b*). Other flexible cleat structures and arrangements are possible without departing from this invention. For example, FIGS. 2A and 2B illustrate a flexible cleat 200 that includes three cleat components 202*a*, 202*b*, and 202*c* arranged around a "capital T-shaped" junction or intersection 222 of two flex grooves 220*a* and 220*b* (either or both of the flex grooves 220*a*, 220*b* may have curvature, if desired). While other specific shapes and arrangements are possible, in this illustrated example, cleat components 202*a* and 202*b* have shapes similar to the fin-type cleat components 134*a*-134*d* described above (and may have any of the various specific structural features and/or options described above for components 134*a*-134*d*). Cleat component 202*c*, on the other hand, has more of a T-shaped structure, and it may have a structure akin to two adjacent cleat components (like 202*a* and 202*b*) pushed together so that one extended wall or side 206*c* faces the groove 220*a*. Cleat component 202*c* has a nadir point 208*c* and a bottom (ground contacting) edge 210*c* that extends (in a straight or curved manner) from the nadir point 208*c* to end points 212*a*, 212*b*, and 212*c*. The bottom edge 210*c* and/or the overall cleat component 202*c* may be sized and shaped (e.g., in the cleat height direction) so as to promote efficient and effective ground penetration.

Figure 3A:
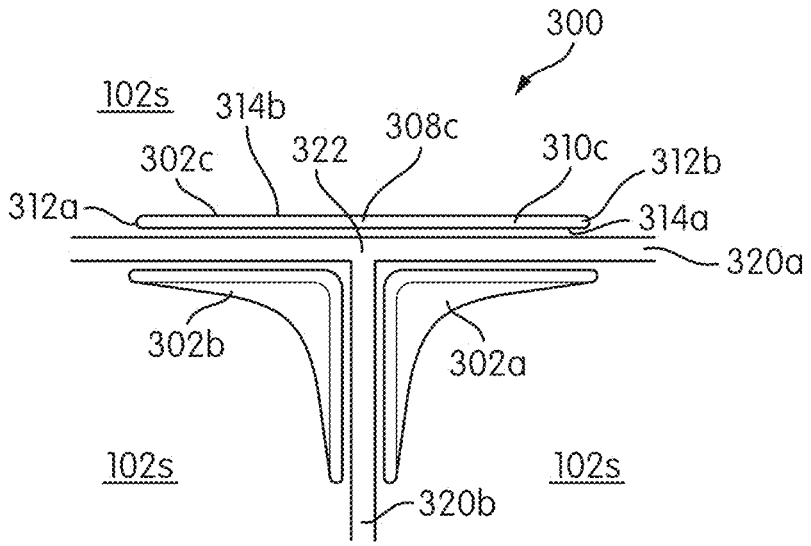
FIGS. 3A and 3B, which illustrate another example flexible cleat structure in accordance with this invention.
Figure 3B:
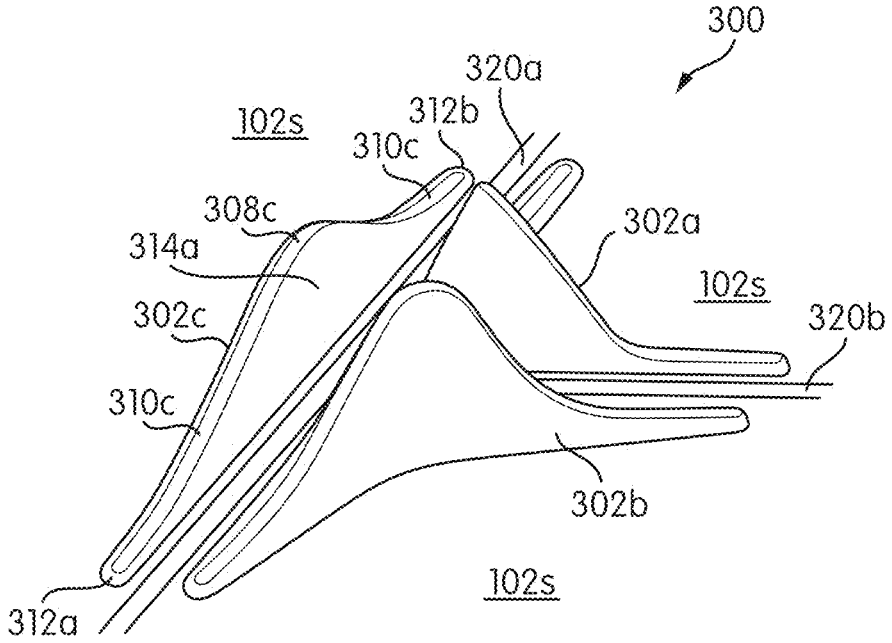

FIGS. 3A and 3B illustrate another example flexible cleat 300 arranged around a "capital T-shaped" junction or intersection 322 of two flex grooves 320*a*, 320*b* (optionally, either or both the flex grooves 320*a*, 320*b* may be curved). Again, while other specific shapes and arrangements are possible, in this illustrated example, cleat components 302*a* and 302*b* have shapes similar to the fin-type cleat components 134*a*-134*d* and 202*a*-202*b* described above (and may have any of the various specific structural features and/or options described above for these cleat components). Cleat component 302*c*, on the other hand, has more of a flat, upright, substantially vertical wall, fin-type structure extending along (and optionally parallel to) the flex groove 320*a*. Cleat component 302*c* has a nadir point 308*c* and a bottom (ground contacting) edge 310*c* that extends (in a straight or curved manner) from the nadir point 308*c* to end points 312*a* and 312*b*. If desired, the cleat component 302*c* may get somewhat thicker moving from the bottom edge 310*c* to the sole base 102*s* (i.e., face 314*a* and/or face 314*b* need not extend at a 90° angle downward from base 102*s*, if desired). The bottom edge 310*c* and/or the overall cleat component 302*c* may be sized and/or shaped (e.g., in the cleat height direction) so as to promote efficient and effective ground penetration.

FIGS. 1A through 3B illustrate flexible cleat structures in which cleat components are arranged around "capital T" or "small T" shaped intersections or junctions of flex grooves (flex grooves having junction angles of about 90°). This also is not a requirement. Rather, if desired, two or more flex grooves may meet at a junction or intersection having any desired angular arrangement or orientation without departing from this invention. Additionally, if desired, the flex grooves need not have a straight construction at or near the location of the junction or intersection (e.g., the grooves may be curved at or near the junction or intersection location, if desired). Also, the interior and exterior side walls of individual cleat components also may be straight or curved (and may generally parallel the longitudinal shape(s) of the grooves).

Figure 4A:
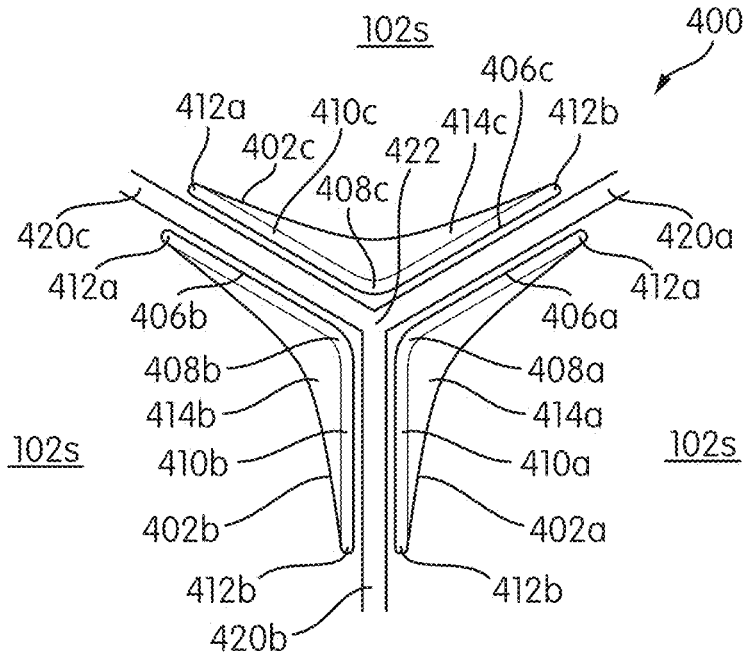
FIGS. 4A and 4B, which illustrate another example flexible cleat structure in accordance with this invention.
Figure 4B:
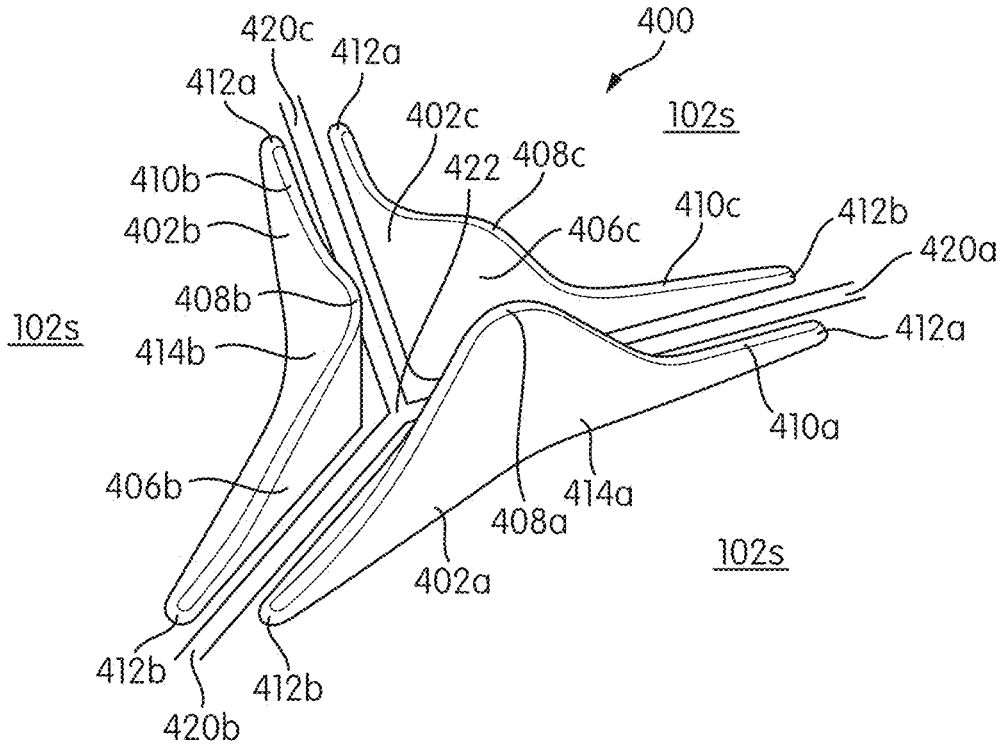

As another more specific example, FIGS. 4A and 4B illustrate a flexible cleat 400 in which three flex grooves 420*a*, 420*b*, and 420*c* meet at a generally "Y-shaped" intersection or junction 422. While the angles between adjacent flex grooves 420*a*-420*c* are substantially the same in the example of FIGS. 4A and 4B (with each angle being about 120° in the illustrated example), the angle between grooves 420*a* and 420*b* may be the same or different from the angle between grooves 420*b* and 420*c*, and the angles between those groove sets may be the same or different from the angle between grooves 420*a* and 420*c*. These angles may range, for example, from 20° to 160°.

In this illustrated example flexible cleat 400, a first cleat component 402*a* is arranged between grooves 420*a* and 420*b*, a second cleat component 402*b* is arranged between grooves 420*b* and 420*c*, and a third cleat component 420*c* is arranged between grooves 420*a* and 420*c*. Each cleat component 402*a*-402*c* includes a vertical or substantially vertical side wall 406*a*-406*c* facing the grooves 420*a*-420*c* and the intersection 422 thereof. Additionally, each cleat component 402*a*-402*c* includes a bottom edge 410*a*-410*c* designed to contact (and potentially penetrate) the ground, and this edge 410*a*-410*c* may taper from nadir portions 408*a*-408*c* to free ends 412*a* and 412*b*. The exposed surfaces 414*a*-414*c* opposite side wall surfaces 406*a*-406*c* may taper or curve outward somewhat so that the cleat components 402*a*-402*c* get somewhat thicker moving in a direction from the ground contacting surface edge 410*a*-410*c* to the sole base 102*s*.

Figure 5A:
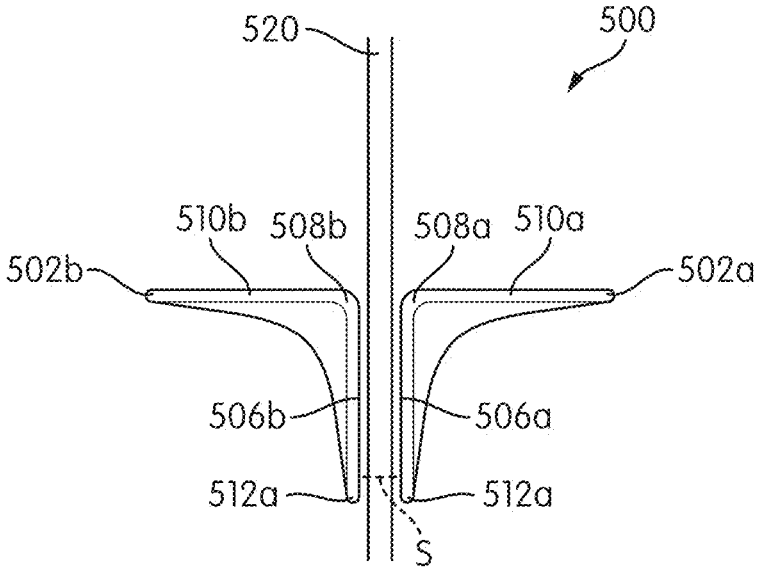
FIGS. 5A and 5B, which illustrate another example flexible cleat structure in accordance with this invention.
Figure 5B:
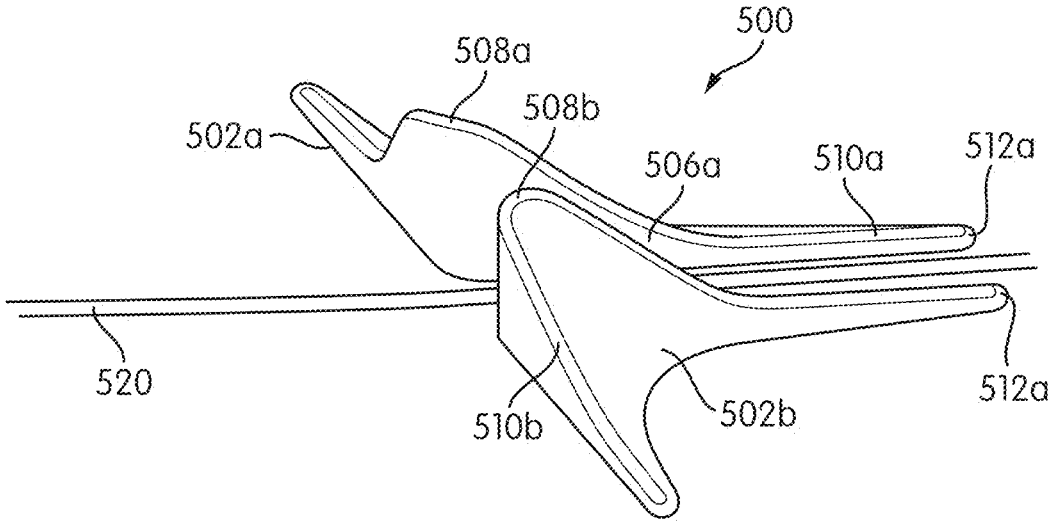

Flexible cleats in accordance with at least some examples of this invention may be arranged around or along a single flex groove (which may be straight or curved). FIGS. 5A and 5B illustrate an example of a flexible cleat 500 in which two cleat components 502*a* and 502*b* (e.g., of the types described above) are arranged on opposite sides of a continuous flex groove 520. As shown in these figures, there is no groove junction or intersection in the areas between or near facing walls 506*a* and 506*b* of the cleat components 502*a* and 502*b*. If desired, in accordance with at least some examples of this invention, the spacing S between the facing walls 506*a* and 506*b* across the groove 520 over at least 75% of the distance from the nadir portion 508*a*, 508*b* to the adjacent free ends 512*a* may be less than 5 mm (and in some examples less than 2.5 mm). The spacing S may be constant or changing, both in the vertical direction (from the ground contacting edge 510*a*, 510*b* to the sole base surface 102*s*), and/or in the nadir 508*a*, 508*b* to free end 512*a* direction.

While each cleat component 502*a* and 502*b* is shown as having a substantially 90° orientation between its two side walls, other angles are possible for these side walls without departing from this invention. For example, if desired, the two side walls of an individual cleat component 502*a* and 502*b* may extend at an angle in the range from 20° to 160°, and in some examples from 35° to 145°, if desired, without departing from this invention. Also, while cleat components 502*a* and 502*b* are shown in these figures as having substantially similar shapes and structures, they may have different shapes and/or structures, including different wall angular orientations, if desired, without departing from this invention.

Figure 6A:
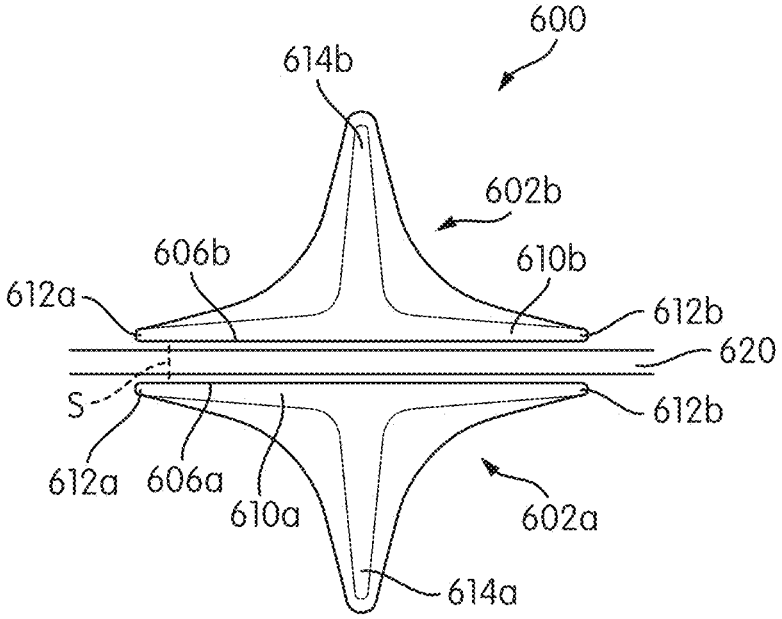
FIGS. 6A and 6B, which illustrate another example flexible cleat structure in accordance with this invention.
Figure 6B:
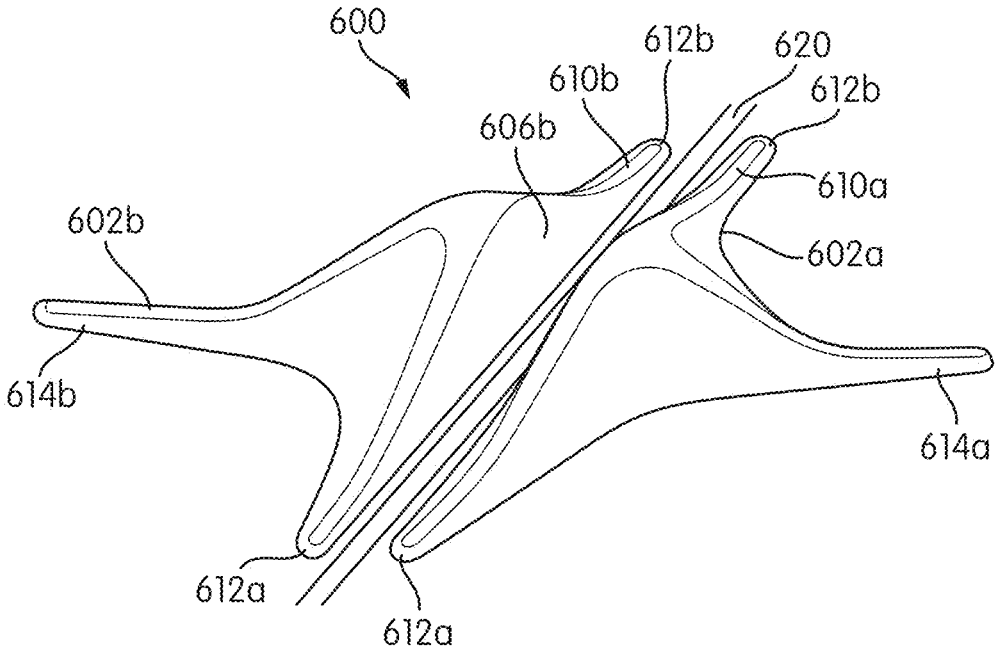

FIGS. 6A and 6B illustrate another example flexible cleat 600 structure arranged along a single, continuous flex groove 620. In this example, the two cleat components 602*a* and 602*b* have the general T-shaped structure shown for cleat component 202*c* of FIGS. 2A and 2B. As shown in these figures, there is no groove junction or intersection in the areas between or near facing side walls 606*a* and 606*b* of the cleat components 602*a* and 602*b*. If desired, in accordance with at least some examples of this invention, the spacing S between the facing walls 606*a* and 606*b* across the groove 620 over at least 75% of the distance from one end 612*a* to the opposite end 612*b* may be less than 5 mm (and in some examples less than 2.5 mm). The spacing S may be constant or changing, both in the vertical direction (from the ground contacting edge 610*a*, 610*b* to the sole base surface 102*s*) and/or in the end 612*a* to end 612*b* direction. The facing side walls 606*a* and 606*b* also may be straight, curved, stepped, and/or otherwise shaped in the direction away from the base surface 102*s*.

While the cleat components 602*a* and 602*b* are shown as having substantially the same size, shape, and structure, they may have different sizes, shapes, and/or structures from those shown without departing from this invention, such as different lengths from end 612*a* to 612*b*, different heights (from base 102*s* to ground contacting edges 610*a*, 610*b*), different sizes, shapes, angles, curvatures, etc. of leg components 614*a*, 614*b*, different angles or orientations of leg components 614*a* and 614*b* (the legs extending away from groove 620) with respect to groove 620, etc. Also, while cleat components 602*a* and 602*b* are shown in these figures as having substantially similar shapes and structures as one another, they may have different structures from one another, if desired, without departing from this invention.

Figure 7A:
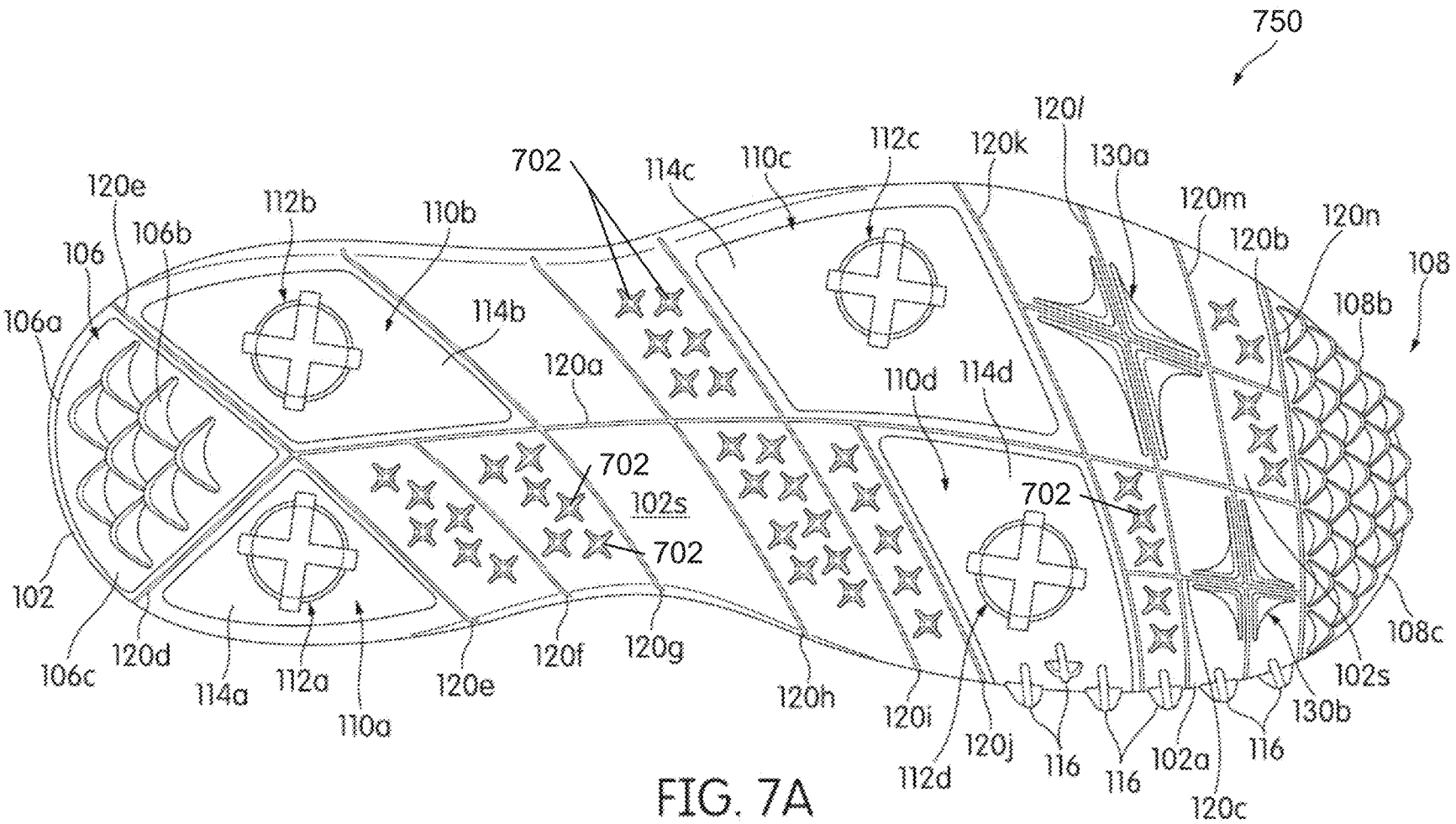
FIGS. 7A and 7B, which illustrate another example sole structure showing additional structure features and options for sole structures in accordance with examples of this invention.
Figure 7B:
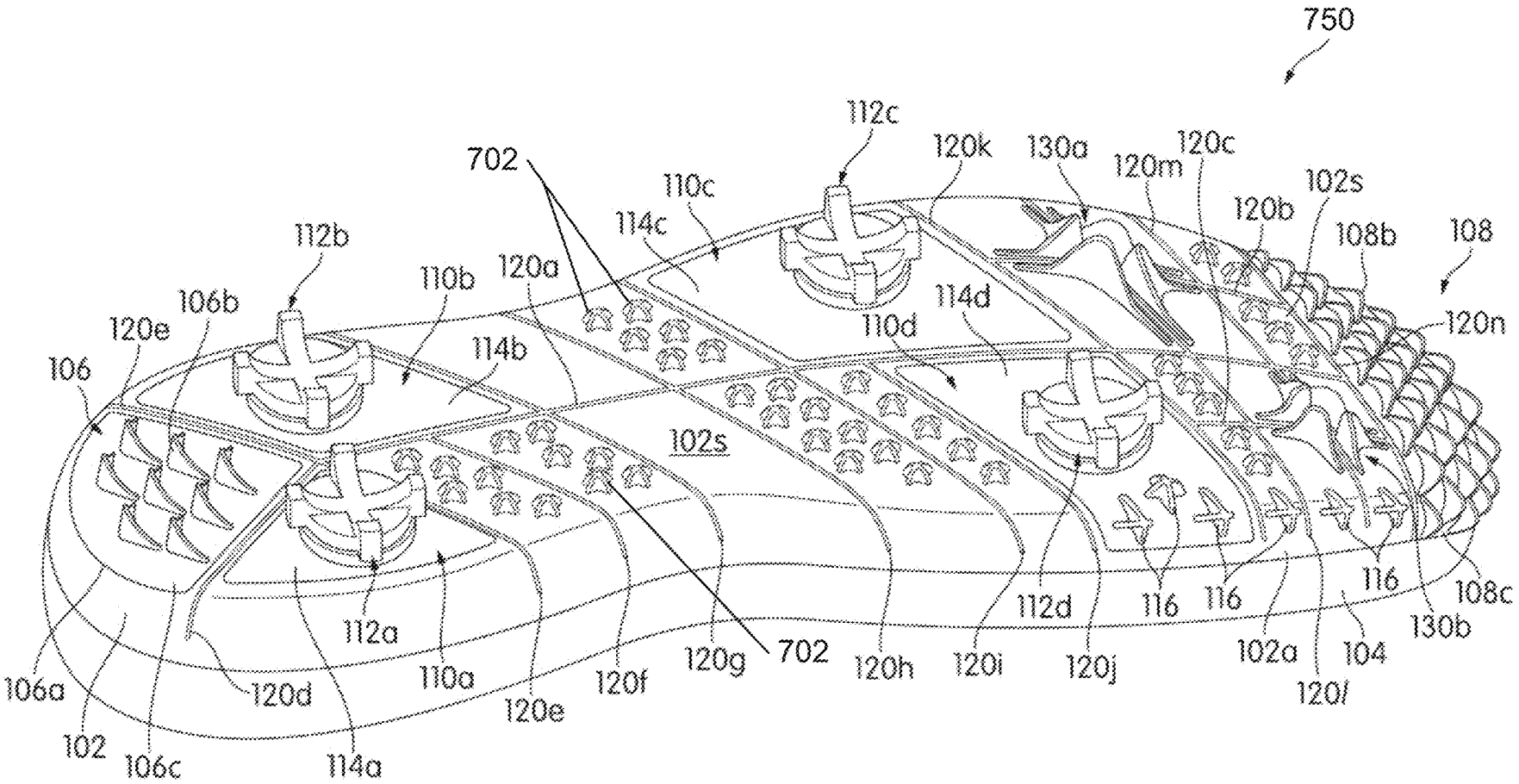

FIGS. 7A and 7B provide bottom and perspective views of another example sole structure 750 in accordance with this invention. Because of the similarity in structure and features, many of the same reference numbers from FIGS. 1A-1G also are used in FIGS. 7A and 7B, and these reference numbers are intended to represent the same or similar parts to those described above (and thus a detailed description of these parts may be omitted). If desired, the sole member of FIGS. 7A and 7B may be the same as that shown in FIGS. 1A and 1B, but with the main (or only) difference being the addition of secondary traction elements 702 in the sole member of FIGS. 7A and 7B.

As shown in these views, several of the flex grooves 120*a*-120*n* may have a curved and/or angular orientation. For example, longitudinal flex groove 120*a* of this example has a generally curved configuration moving from the front to the back (with the concave side of the curve facing the medial side of the sole structure 750 and the convex side of the curve facing the lateral side of the sole structure 750). The forefoot longitudinal flex grooves 120*b* and 120*c* are angled and/or curved in the forward medial to rear lateral direction. At the forefoot area, flex grooves 120*a*-120*c* may extend substantially parallel to one another.

Flex grooves 120*e*-120*n* of this illustrated example also extend at an angled and/or in a curved manner. As shown in FIGS. 7A and 7B, these flex grooves 120*e*-120*n* are located further forward in the overall sole structure 750 at their medial ends as compared to their respective lateral ends (i.e., the flex grooves 120*e*-120*n* extend in a forward medial to rearward lateral direction in a curved or straight path). The flex groove size, shape, arrangement, and orientation of FIGS. 7A and 7B also may be used in other embodiments of this invention, including in the embodiment of FIGS. 1A-1G.

The flexibility of the sole member 102 and/or the flex groove construction and orientation (including the flex grooves 120*e*-120*n* extending in the forward medial-to-rearward lateral direction) helps the sole structure 750 maintain better and closer ground contact, particularly during plantar-flexion motion, e.g., during phases of a golf swing, a step cycle, and/or other activities. For example, more surface area of the sole structure 750 remains in contact with the ground during a swing and/or step cycle, particularly during plantar-flexion phases of these cycles.

The example sole structure 750 of FIGS. 7A and 7B further shows secondary traction elements 702, e.g., in the form of raised nubs (optionally somewhat wider at their base than at their free ends), provided at various locations around the bottom surface of the sole member 750, e.g., at locations between various flex grooves. While the sizes, shapes, positioning, and orientation of the secondary traction elements 702 may vary widely without departing from this invention, additional secondary traction elements 702 may be provided at one or more of the following locations in a sole structure 750: (a) between flex grooves 120*b* and 120*m* and the lateral side of sole structure 750 (and the forward traction element 108 of the sole structure 750); (b) between flex grooves 120*a*, 120*b*, and 120*m* (and the forward traction element 108 of the sole structure 750); (c) between flex grooves 120*a*, 120*c*, 120*k*, and 120*l*; (d) between flex grooves 120*c*, 120*k*, and 120*l* and the medial side of the sole structure 750; (e) between flex grooves 120*a*, 120*i*, and 120*j* and the medial side of the sole structure 750; (f) between flex grooves 120*a*, 120*h*, and 120*i* and the medial side of the sole structure 750; (g) between flex grooves 120*a*, 120*h*, and 120*i* and the lateral side of the sole structure 750; (h) between flex grooves 120*a*, 120*f*, and 120*g* and the medial side of the sole structure 750; and (i) between flex grooves 120*a*, 120*e*, and 120*f* and the medial side of the sole structure 750. In the specific sole structure 750 example shown in FIGS. 7A and 7B, one or more additional secondary traction elements 702 are provided in all of these enumerated locations.

Additional side projecting traction enhancing elements 116 also are provided around the medial forefoot and toe area of the sole member 750 (with additional side projecting traction enhancing elements located further forward toward to the front of the sole member 750 as compared to the example structure 100 shown in FIGS. 1A and 1B). The side projecting traction enhancing elements 116 provide additional traction, e.g., during downswing, ball contact, and/or toe-off phase(s) of a golf swing cycle, a step cycle, and/or other activities. The side projecting traction enhancing elements 116 may extend around the sole member 102 perimeter even further forward (e.g., to the toe area) and/or rearward (e.g., to the arch or heel areas), if desired.

In the example structures described above, cleat elements 112*a*-112*d* are releasably engaged with the sole member 102, and the flexible cleat elements 130*a* and 130*b* are integrally formed with the sole member 102 (e.g., via molding or rapid manufacturing processes). Other arrangements and constructions are possible for either or both of these cleat types without departing from this invention. FIGS. 8A-8G illustrate another example method or manner in which cleat elements, including flexible cleat elements 130*a* and 130*b* described above, may be incorporated into a sole structure 100.

Figure 8A:
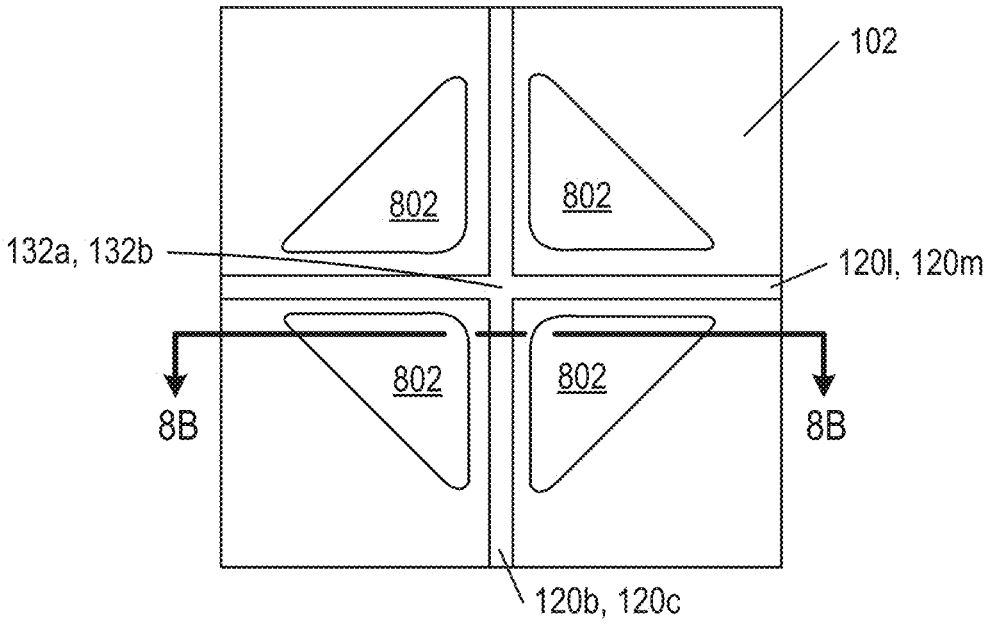
FIGS. 8A-8H, which provide various views illustrating example structures and methods of making at least a portion of sole structures in accordance with this invention.
Figure 8B:
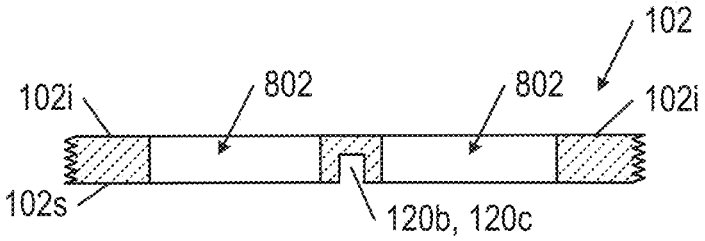
Figure 8C:
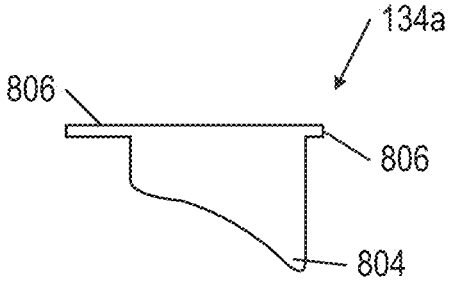
Figure 8D:
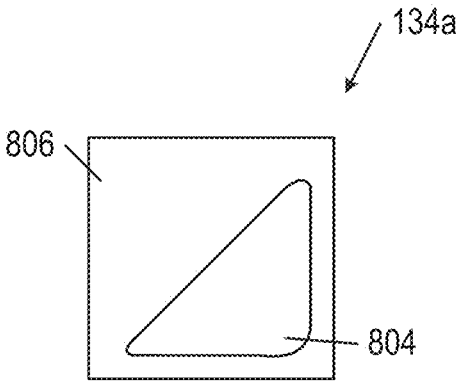

FIG. 8A shows a portion of a sole member 102 at an area near a junction (e.g., 132*a*, 132*b*) between two intersecting flex grooves (e.g., 120*b* and 120*l* or 120*c* and 120*m*), and FIG. 8B is a cross sectional view of the sole member 102 taken along line 8B-8B in FIG. 8A. As one step in this process, the sole member 102 may be formed (e.g., molded) to include one or more through holes 802 at the location(s) corresponding to the positions of one or more of the cleat elements 112*a*-112*d*, 130*a*, and/or 130*b*. The cleat elements (e.g. shaped as cleat elements 112*a*-112*d*, shaped as cleat elements 130*a*-130*b*, shaped as individual cleat components 134*a*-134*d*, etc.) may be separately formed, e.g., via a molding process. FIGS. 8C and 8D show side and bottom views, respectively, of an example cleat component 134*a*. As shown in these figures, cleat component 134*a* of this example includes a ground engaging portion 804 (e.g., including the nadir portions of the cleat components described above) that extends away from a mounting base 806. The mounting base 806 may constitute a thin (and optionally flexible) disk or rim (or at least a disk or rim provided around a portion of the perimeter of the cleat component 134*a*) that helps retain the cleat component 134*a* in the overall sole structure, as will be described in more detail below. While FIGS. 8C and 8D show cleat component 134*a* as a unitary, one piece construction, cleat components could be made from multiple parts that are fixed together (e.g., by adhesives or mechanical connectors), if desired, without departing from this invention.

Figure 8F:
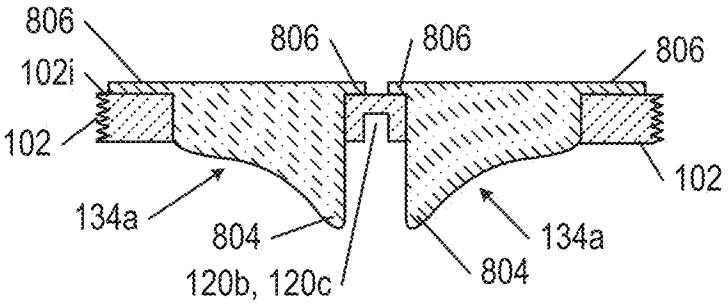
Figure 8H:
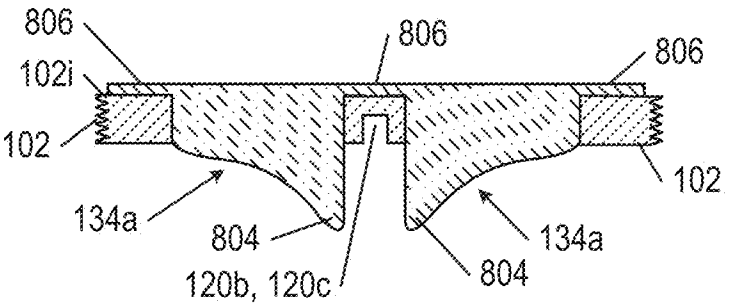
Figure 8E:
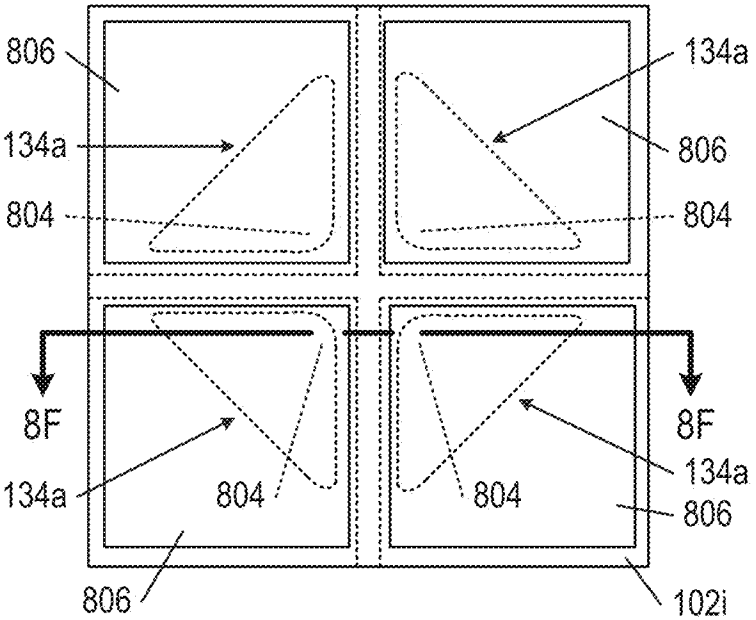

Once the individual parts are produced, the cleat component 134*a* may be engaged with the sole member 102 as shown in FIGS. 8E and 8F. More specifically, as shown, the ground engaging portion 804 of the cleat component 134*a* may be inserted through the top of a hole 802 provided in the sole member 102, and the perimeter or rim of the mounting base 806 will engage the top surface 102*i* of the sole member 102 to keep the cleat component 134*a* from going through the hole 802. While other arrangements are possible, in the example structure and method shown in FIGS. 8E and 8F, one cleat component 134*a*-134*d* is provided for each respective hole 802 through the sole member 102, and the cleat components 134*a* remain separated from one another at the top surface 102*i* of the sole member 102.

Figure 8G:
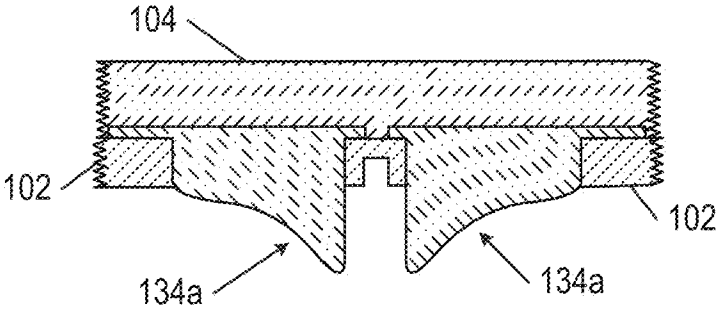

Optionally, if necessary or desired, the cleat component(s) 134*a*-134*d* may be engaged with the top surface 102*i* of the sole member 102 using a cement or adhesive (although omitting any cements or adhesives for this purpose, if practicable, can help provide a "greener," more environmentally friendly, and sustainable construction). Then, as shown in the cross sectional view of FIG. 8G, the top of the sole member 102 and the cleat component(s) 134*a*-134*d* may be covered, e.g., by midsole member 104 (e.g., by one or more pieces of a polymeric midsole foam material). While not necessary in all constructions, if desired, the midsole member 104 may be engaged with the other sole structures (e.g., sole member 102 and/or cleat components 134*a*-134*d*) via cements or adhesives. This overall sole structure (e.g., as shown in FIG. 8G) then may be engaged with an upper, e.g., in manners as are conventionally known and used in the footwear art.

While the example sole structure 750 of FIGS. 8A-8G shows each cleat component 134*a* as a separate part, this is not a requirement. Rather, as shown in FIG. 8H, a single cleat component 134*a* may include multiple ground engaging portions 804 (e.g., from 2-4) so that a single cleat component part 134*a* will have ground engaging portions 804 extending through more than one of the through holes 802 provided in the sole member 102 (e.g., akin to 2 or more (e.g., 2-4) of the cleat component parts 134*a* of FIGS. 8E-8G formed as a single, unitary construction). In other words, as shown in FIG. 8H, a thin layer of cleat component material may extend between adjacent ground engaging portions 804 and over at least some of the areas above the flex grooves 120*b*, 120*c*, 1201, and/or 120*m*. Such structures may be used, for example, if the base portions 806 of the cleat component 134*a* between adjacent ground engaging portions 804 (and over the flex grooves) are sufficiently thin and/or flexible so as to maintain sufficient flexibility for the overall sole structure (e.g., to support natural motion). Forming a single cleat component to include multiple ground engaging portions 804 (e.g., from 2-4 of the ground engaging portions of FIG. 8E) (and/or that will extend through multiple through holes 802, including from 2-4 of the through holes 802 of FIG. 8E) in this manner may simplify the manufacturing process for the overall sole structure (e.g., requiring handling and engagement of fewer cleat component parts with the sole member 102).

As another option or example, if desired, the cleat elements and/or components need not extend through openings defined through the sole member 102. For example, if desired, cleat elements and/or components may be simply engaged with the exposed bottom surface 102*s* of the sole member 102, e.g., using cements or adhesives, mechanical connectors, or the like. One advantage of using the multipart part construction for the sole member 102 and the cleat elements and/or components (e.g., cleat elements 112*a*-112*d*, cleat elements 130*a*-130*b*, individual cleat components 134*a*-134*d*, etc.) as described above and shown in FIGS. 8A-8H is that it allows the manufacturer to make the sole member 102 and the cleat elements and/or components 134*a*-134*d* from different materials. As a more specific example, using these type of multipart structures and manufacturing techniques, the cleat elements and/or components (e.g., cleat elements 112*a*-112*d*, cleat elements 130*a*-130*b*, individual cleat components 134*a*-134*d*, etc.) can be made from a different, harder, more durable, and/or more rigid material as compared to the material making up the sole member 102 (or other portions of the sole structure). This feature may help provide a more durable and longer lasting cleat and sole structure.

When a flexible cleated sole structure includes more than one flexible cleat, the flexible cleats on that individual sole structure may have the same or different sizes, shapes, and/or other structural features without departing from this invention, including, for examples, combinations of any two or more of the flexible cleat structures shown in FIGS. 1A-8H and/or combinations of any of these flexible cleat structures with another flexible cleat structure having a different size, shape, appearance, and/or orientation. Also, while FIGS. 1A, 1B, 7A, and 7B show the flexible cleats on a sole structure in combination with other, more conventional cleats, if desired, one or more flexible cleats may be the only type of traction enhancing elements on a sole structure without departing from this invention. The flexible cleats also may be located at any desired positions on the sole structure. For example, while FIGS. 1A and 1B show the flexible cleats 130*a* and 130*b* located in the forefoot toe area of the sole structure 102 (beneath the big and one or more of the smallest toes), flexible cleats may be located at other positions as well, including one or more of: the forefoot area beneath the first (big toe or medial side) metatarsal-phalangeal joint or metatarsal head, the forefoot area beneath the fourth or fifth (smaller toes or lateral side) metatarsal-phalangeal joint(s) or metatarsal head(s), in the lateral heel area, in the medial heel area, etc.

FIG. 1A further illustrates a portion of an upper 700 that may be included in footwear structures in accordance with this invention. Sole structures in accordance with this invention may be incorporated into footwear having any desired types of uppers without departing from this invention, including conventional uppers as are known and used in the art (including conventional uppers for golf or other athletic footwear). As some more specific examples, uppers in accordance with at least some examples of this invention may include uppers having foot securing and engaging structures (e.g., "dynamic" and/or "adaptive fit" structures) of the types described in U.S. Patent Appln. Publication No. 2013/0104423, which publication is entirely incorporated herein by reference. As some additional examples, if desired, uppers and articles of footwear in accordance with this invention may include foot securing and engaging structures of the type used in FLYWIRE® Brand footwear available from NIKE, Inc. of Beaverton, Oreg. Additionally or alternatively, if desired, uppers and articles of footwear in accordance with this invention may include knit materials and/or fused layers of upper materials, e.g., uppers of the types included in NIKE "FLYKNIT™" Brand footwear products and/or NIKE's "FUSE" line of footwear products. As additional examples, uppers of the types described in U.S. Pat. Nos. 7,347,011 and/or 8,429,835 may be used with the sole members described above without departing from this invention (each of U.S. Pat. Nos. 7,347,011 and 8,429,835 is entirely incorporated herein by reference).

III. CONCLUSION

The present invention is disclosed above and in the accompanying drawings with reference to a variety of embodiments and structural options. The purpose served by the disclosure, however, is to provide examples of the various features and concepts related to the invention, not to limit the scope of the invention. Those skilled in the art will understand that the structures, options, and/or alternatives for the cleat structures, sole structures, footwear structures, and/or methods described herein, including the features of the various different embodiments of the invention, may be used in any desired combinations, subcombinations, and the like, without departing from the invention. Those skilled in the relevant art also will recognize that numerous variations and modifications may be made to the embodiments described above without departing from the scope of the present invention, as defined by the appended claims.

What is claimed is:

1. A sole structure for an article of footwear, comprising:

a sole member including a longitudinal flex groove; and a pair of flexible cleats including: (a) a first flexible cleat extending from the sole member and arranged around a first junction of a first flex groove and a second flex groove, wherein the first junction is located on a lateral side of the longitudinal flex groove, and (b) a second flexible cleat extending from the sole member and arranged around a second junction of a third flex groove and a fourth flex groove, wherein the second junction is located on a medial side of the longitudinal flex groove, wherein each of the first flexible cleat and the second flexible cleat includes a flexible cleat structure consisting of:

a first cleat component that includes: (a) a first side wall extending along flex grooves that form a respective junction around which said flexible cleat structure is arranged, (b) a first bottom edge, wherein each of the first side wall and the first bottom edge extends from a first free end located adjacent one flex groove around which said flexible cleat structure is arranged to a second free end located adjacent another flex groove around which said flexible cleat structure is arranged, wherein the first bottom edge defines a first nadir portion of the first cleat component located along the first side wall adjacent the respective junction around which said flexible cleat structure is arranged and between the first free end and the second free end, and (c) a first exposed wall located opposite the first side wall and extending from the first free end to the second free end, and wherein a base of the first exposed wall forms a circular arc or parabolic path from the first free end to the second free end, a second cleat component that includes: (a) a second side wall extending along the flex grooves that form the respective junction around which said flexible cleat structure is arranged, (b) a second bottom edge, wherein each of the second side wall and the second bottom edge extends from a third free end located adjacent one flex groove around which said flexible cleat structure is arranged to a fourth free end located adjacent another flex groove around which said flexible cleat structure is arranged, wherein the second bottom edge defines a second nadir portion of the second cleat component located along the second side wall adjacent the respective junction around which said flexible cleat structure is arranged and between the third free end and the fourth free end, and (c) a second exposed wall located opposite the second side wall and extending from the third free end to the fourth free end, and wherein a base of the second exposed wall forms a circular arc or parabolic path from the third free end to the fourth free end, a third cleat component, and a fourth cleat component, and wherein the first flexible cleat and the second flexible cleat are the only cleats in the sole structure having the flexible cleat structure.

2. The sole structure according to claim 1, wherein the third cleat component includes a third side wall extending along at least one of the flex grooves around which said flexible cleat structure is arranged.

3. The sole structure according to claim 1, wherein the third cleat component includes: (a) a third side wall extending along the flex grooves that form the respective junction around which said flexible cleat structure is arranged, (b) a third bottom edge, wherein each of the third side wall and the third bottom edge extends from a fifth free end located adjacent one flex groove around which said flexible cleat structure is arranged to a sixth free end located adjacent another flex groove around which said flexible cleat structure is arranged, wherein the third bottom edge defines a third nadir portion of the third cleat component located along the third side wall adjacent the respective junction around which said flexible cleat structure is arranged and between the fifth free end and the sixth free end, and (c) a third exposed wall located opposite the third side wall and extending from the fifth free end to the sixth free end, and wherein a base of the third exposed wall forms a circular arc or parabolic path from the fifth free end to the sixth free end.

4. The sole structure according to claim 3, wherein the fourth cleat component includes: (a) a fourth side wall extending along the flex grooves that form the respective junction around which said flexible cleat structure is arranged, (b) a fourth bottom edge, wherein each of the fourth side wall and the fourth bottom edge extends from a seventh free end located adjacent one flex groove around which said flexible cleat structure is arranged to an eighth free end located adjacent another flex groove around which said flexible cleat structure is arranged, wherein the fourth bottom edge defines a fourth nadir portion of the fourth cleat component located along the fourth side wall adjacent the respective junction around which said flexible cleat structure is arranged and between the seventh free end and the eighth free end, and (c) a fourth exposed wall located opposite the fourth side wall and extending from the seventh free end to the eighth free end, and wherein a base of the fourth exposed wall forms a circular arc or parabolic path from the seventh free end to the eighth free end.

5. The sole structure according to claim 4, wherein the second junction is located in a first metatarsal head support area of the sole structure or in a big toe support area of the sole structure, and wherein the first junction is located in at least one of a fourth metatarsal head support area or a fifth metatarsal head support area of the sole structure or in at least one of a fourth toe support area or a fifth toe support area of the sole structure.

6. The sole structure according to claim 4, wherein the first flexible cleat is located in a forefoot area of the sole structure and closer to a lateral side edge of the sole structure than to a medial side edge of the sole structure, and wherein the second flexible cleat is located in the forefoot area of the sole structure and closer to the medial side edge of the sole structure than to the lateral side edge of the sole structure.

7. The sole structure according to claim 4, wherein the first cleat component, the second cleat component, the third cleat component, and the fourth cleat component of the flexible cleat structure are formed as a single part that is engaged with the sole member.

8. The sole structure according to claim 4, wherein in the flexible cleat structure: an exposed, ground contacting surface of the first bottom edge is less than 2 mm wide, an exposed, ground contacting surface of the second bottom edge is less than 2 mm wide, an exposed, ground contacting surface of the third bottom edge is less than 2 mm wide, and an exposed, ground contacting surface of the fourth bottom edge is less than 2 mm wide.

9. The sole structure according to claim 4, wherein in the flexible cleat structure: the first side wall is curved around a first area adjacent the first junction, the second side wall is curved around a second area adjacent the first junction, the third side wall is curved around a third area adjacent the first junction, and the fourth side wall is curved around a fourth area adjacent the first junction.

10. The sole structure according to claim 4, wherein in the flexible cleat structure: the first side wall extends downward and away from a base surface of the sole member toward the first bottom edge at an angle of from 90° to 110°, the second side wall extends downward and away from the base surface of the sole member toward the second bottom edge at an angle of from 90° to 110°, the third side wall extends downward and away from the base surface of the sole member toward the third bottom edge at an angle of from 90° to 110°, and the fourth side wall extends downward and away from the base surface of the sole member toward the fourth bottom edge at an angle of from 90° to 110°.

11. The sole structure according to claim 1, wherein the second junction is located in a first metatarsal head support area of the sole structure or in a big toe support area of the sole structure.

12. The sole structure according to claim 1, wherein the first junction is located in at least one of a fourth metatarsal head support area or a fifth metatarsal head support area of the sole structure or in at least one of a fourth toe support area or a fifth toe support area of the sole structure.

13. The sole structure according to claim 1, wherein the first flexible cleat is located in a forefoot area of the sole structure and closer to a lateral side edge of the sole structure than to a medial side edge of the sole structure.

14. The sole structure according to claim 1, wherein the second flexible cleat is located in a forefoot area of the sole structure and closer to a medial side edge of the sole structure than to a lateral side edge of the sole structure.

15. The sole structure according to claim 1, wherein the first junction is located in a forefoot area of the sole member.

16. The sole structure according to claim 1, wherein the first flexible cleat is integrally formed with the sole member.

* * * * *